US008555519B2

(12) United States Patent
McFarland

(10) Patent No.: US 8,555,519 B2
(45) Date of Patent: Oct. 15, 2013

(54) SYSTEMS AND METHODS FOR DRYING A PLURALITY OF DIVERSE ARTICLES

(76) Inventor: Martin Allen McFarland, Boulder, CO (US)

( * ) Notice: Subject to any disclaimer, the term of this patent is extended or adjusted under 35 U.S.C. 154(b) by 386 days.

(21) Appl. No.: 11/665,394

(22) PCT Filed: Sep. 20, 2005

(86) PCT No.: PCT/US2005/034086

§ 371 (c)(1),
(2), (4) Date: Apr. 13, 2007

(87) PCT Pub. No.: WO2006/034430

PCT Pub. Date: Mar. 30, 2006

(65) Prior Publication Data

US 2008/0134538 A1 Jun. 12, 2008

Related U.S. Application Data

(60) Provisional application No. 60/611,444, filed on Sep. 20, 2004.

(51) Int. Cl.
*F26B 19/00* (2006.01)

(52) U.S. Cl.
USPC ..... 34/201; 34/202; 34/209; 34/226; 34/229; 34/233; 34/622; 190/124; 190/125

(58) Field of Classification Search
USPC ..... 34/201, 209, 229, 226, 202, 622, 233; 190/124, 125
See application file for complete search history.

(56) References Cited

U.S. PATENT DOCUMENTS

| | | | | |
|---|---|---|---|---|
| 1,172,708 | A * | 2/1916 | Hoard | 190/125 |
| 1,353,358 | A | 9/1920 | Steenfeldt-Lindholm | |
| 1,871,773 | A | 8/1932 | Abel | |
| 3,552,035 | A * | 1/1971 | Olin | 34/191 |
| 3,752,373 | A * | 8/1973 | Smith | 223/51 |

(Continued)

FOREIGN PATENT DOCUMENTS

| | | |
|---|---|---|
| CA | 2580617 B2 | 3/2006 |
| CH | 107044 | 10/1924 |

(Continued)

OTHER PUBLICATIONS

International Search Report for PCT/US2005/034086 dated May 5, 2006.

(Continued)

*Primary Examiner* — Kenneth Rinehart
*Assistant Examiner* — Bao D Nguyen
(74) *Attorney, Agent, or Firm* — Bryan Cave LLP

(57) ABSTRACT

Apparatus for treatment of multiple articles located in separate chambers (38) for treatment with an ambient or heated, and/or treated air flow stream (44); and processes for drying multiple articles located in the separate chambers (38) using an ambient or heated, and/or treated air flow stream (44). The chambers (38) are within a container or form a container (36), and the chambers (38) are connected in a manner that defines a virtual air flow stream tube having a length in excess of any single nominal length dimension or of any nominal internal width dimension or of any nominal internal height dimension of the container so that any to-be-treated items supported within any chamber is treated with air flow stream (44).

25 Claims, 10 Drawing Sheets

(56) References Cited

U.S. PATENT DOCUMENTS

| | | | | |
|---|---|---|---|---|
| 4,100,682 | A | 7/1978 | Corrigan | |
| 4,110,916 | A | 9/1978 | Bemrose | |
| 5,185,939 | A * | 2/1993 | Kimura | 34/105 |
| 5,369,892 | A * | 12/1994 | Dhaemers | 34/275 |
| 5,413,199 | A * | 5/1995 | Clement | 190/108 |
| 5,555,640 | A | 9/1996 | Ou | |
| 5,730,006 | A * | 3/1998 | Conley | 68/6 |
| 5,930,915 | A * | 8/1999 | Dhaemers | 34/511 |
| 6,134,806 | A * | 10/2000 | Dhaemers | 34/404 |
| 6,263,591 | B1 | 7/2001 | LaPorte | |
| 6,327,792 | B1 * | 12/2001 | Hebert | 34/104 |
| 6,446,809 | B2 * | 9/2002 | Flynn | 206/523 |
| 6,780,101 | B2 * | 8/2004 | Buhler et al. | 34/437 |
| 6,840,068 | B2 * | 1/2005 | Pasin et al. | 68/5 C |
| 6,889,449 | B2 * | 5/2005 | Silver | 34/490 |
| 2002/0067108 | A1 * | 6/2002 | Doan et al. | 312/204 |
| 2003/0188943 | A1 * | 10/2003 | Freedman | 190/112 |
| 2003/0205601 | A1 * | 11/2003 | Kilduff | 224/627 |
| 2004/0134087 | A1 * | 7/2004 | Meyer | 34/90 |
| 2004/0211227 | A1 * | 10/2004 | Jackson et al. | 68/5 C |
| 2005/0127056 | A1 * | 6/2005 | Petkov et al. | 219/211 |
| 2005/0160617 | A1 * | 7/2005 | Fouts, II | 34/202 |
| 2005/0281494 | A1 * | 12/2005 | Allen et al. | 383/109 |
| 2008/0118411 | A1 * | 5/2008 | D'Arinzo | 422/186.09 |
| 2008/0134538 | A1 * | 6/2008 | McFarland | 34/209 |

FOREIGN PATENT DOCUMENTS

| | | |
|---|---|---|
| DE | 29612232 | 10/1996 |
| EP | 1472968 | 3/2004 |
| FR | 500932 | 3/1920 |
| FR | 892596 | 4/1944 |
| GB | 6949 | 0/1911 |
| GB | 191329774 | 0/1914 |
| GB | 523437 | 7/1940 |
| JP | 2003-164697 | 6/2003 |

OTHER PUBLICATIONS

Written Opinion for PCT/US2005/034086, dated May 11, 2006.

Extended EPO Search Report for EPO App 05800734.5, dated Apr. 29, 2009.

Office Action for EPO App 05800734, dated Jun. 29, 2011.

Office Action dated Apr. 16, 2012, issued in European Application No. 05800734.5.

* cited by examiner

SYSTEMS AND METHODS FOR DRYING A PLURALITY OF DIVERSE ARTICLES

RELATED APPLICATION

The present application claims the benefit under title 35 United States Code, Section ii 9(e) of U.S. provisional application No. 60/611,444 filed Sep. 20, 2004 entitled "Drying and Sanitizing Sports Bag".

BACKGROUND OF THE INVENTION

1. Field of the Invention

Drying apparatus for multiple articles located in separate chambers for treatment with an ambient or heated, and/or treated air flow stream; and processes for drying multiple articles located in separate chambers using an ambient or heated, and/or treated air flow stream.

2. Description of the Prior Art

Active sports such as hockey, football, lacrosse, and the like require, in addition to sports clothing, equipment for use in playing the game and for protecting the player. Such clothing and equipment items are usually not worn to and from the sporting event or practice; but are usually transported in some sort of a portable closed container such as a sports bag or specialty container. During vigorous play such clothing and equipment items tend to become damp or wet with the player's perspiration, and also by being exposed to wet weather or wet playing conditions. After play or practice is completed, if such damp or wet gear is left in a closed container, the gear tends to be acted upon by bacteria and mold, and as a result, becoming foul smelling and rank, and subject to deterioration. Research has shown that such odors are a byproduct of bacteria and mold that grow readily in the moist, dark generally stagnant environment inside the closed container. Some of the resulting bacteria may also become a source for infections when they come into contact with an open cut or abrasion on the body of a user the next time the gear is worn. In addition, items left inside a closed container dry so slowly that they may still be wet the next time they are removed from the closed container.

In order to dry their equipment and to prevent the secondary problems noted above, athletes have taken such mundane steps as spreading their damp items out on the floor or hanging them on racks after each use, and then returning them to the container. In more aggressive efforts, they have taken the steps of removing their damp items from their containers, and then used standard or specialized equipment to dry them, and then returning them to the container. There have also been several specialized bags, devices, or containers developed to dry and sanitize athletic equipment or clothing of athletes. Some are small and portable, some are large and stationary, some are hard sided and some are made of flexible material. Of these, some are intended to dry the to-be-treated-items while others only sanitize them. Most of these known prior art systems for treating damp to-be-treated-items have some common characteristics. Further discussion of prior art drying and sanitizing containers are set forth in greater detail below in the discussion of FIG. 1, under the "DESCRIPTION AND DISCUSSION OF THE PRIOR ART". FIG. 1 shows, diagrammatically, several examples of prior art drying systems, all of which are quite different in structure and operation from the structure and operation of the present invention as described below.

As is discussed below and shown in FIG. 1, it will be seen that a fair analysis of the known shown and discussed prior art drying and sanitizing container systems leads to a conclusion that they suffer from the same short comings. Those shortcomings include the fact that once a drying air flow stream has been passed into a drying chamber, the drying air flow stream is subject to being blocked and diverted by the to-be-treated-items in the drying chamber. Also, external conduits, enclosed mixing chambers, multiple fans, manifolds, and distributors add cost and complexity to the prior art drying units.

In all of the known prior art systems, the problem of dead air spots, reduced air stream flow, and of obstructive blockages of the air flow stream still remain. It will be seen that in every system, once the drying air passes into the drying chamber, it is poorly directed to and around the to-be-treated-items. Therefore, there clearly exists a need for a more effective apparatus and method for applying an effective quality, quantity, and velocity of drying air flow stream or sanitizing agent directly to the to-be-treated-items in a system that is inexpensive and uncomplicated by multiple fans, manifolds, and distributors.

It will be seen that the drying systems of the present invention provide a solution to the aforementioned and below described problems, by providing structures and operations that can, for example, move a single air flow stream through a series of serially connected chambers, thereby resulting in an efficient, effective, inexpensive, uncomplicated drying and sanitizing structure and operation.

SUMMARY OF THE INVENTION

It is therefore an object of the present invention to provide a multiple to-be-treated-item drying system that moves an air flow stream through a series of separate, but interconnected chambers to provide an efficient, inexpensive, uncomplicated drying and/or sanitizing and/or odorizing apparatus and operation.

As used herein, a "chamber" is or defines a discrete area of volume for location within or adjacent to a container of the present invention. Each chamber will be, in general, defined by circumferentially surrounding surfaces, including a surface portion having an air flow stream inlet, and a surface portion having an air flow stream outlet. While they may, neither the inlet portion nor the outlet portion requires walls or surfaces. For all practical purposes, each chamber will include a floor portion or equivalent or a hanger or support for supporting at least one to-be-treated item. As used herein, a "support" is or defines a floor portion or equivalent or a hanger or support for supporting at least one to-be-treated item. As described in greater detail below, each chamber is in air flow stream connection in series or in parallel to at least one adjacent chamber, or to an air flow stream inlet or an air flow stream outlet and at least one adjacent chamber.

It is another object of the present invention to provide such a system, method and apparatus for drying and/or sanitizing and/or odorizing to-be-treated-items within a drying chamber including interconnected chambers within a portable container.

It is a further object of the present invention to provide such a structure and operation wherein the interconnected chambers form a virtual tube having a length in excess of any single length dimension or width dimension or height dimension of the container.

It is a yet another object of the present invention to provide such a virtual tube within a container in which the virtual tube is tortuously organized to provide a path for a drying and/or treating air flow stream, wherein the placement of the interconnected chambers in a tortuous pattern increases the effective length of the drying and/or treating system without changing the outside dimensions of the container.

It is a still further object of the present invention to provide such tortuous virtual tube systems including two or more interconnected chambers through which a controlled air flow stream having an adequate quality, quantity, velocity, and direction may be controlled and channeled over, around and through a number of to-be-dried and/or to-be-treated-items in several adjacent and interconnected chambers.

Another object of the present invention is to provide a multiple article drying and/or treatment container having as few as a single air flow stream inlet and a single air flow stream outlet.

Yet another object of the present invention is to provide two or more interconnected chambers, each chamber having a clog resistant air flow stream inlet and a clog resistant air flow stream outlet, such that one or more to-be-treated-items may be placed within each chamber for sequential air flow stream treatment.

Another object of the present invention is to include a porous air permeable liner around or along some or all of the separate chambers within the container to provide for an air flow stream to allow for treatment of non-porous to-be-treated-items.

A related additional object and purpose of the present invention is the provision of a porous permeable liner around or along some or all of the chambers within the container to allow a treating air flow stream to bypass any blockages that may occur in any chamber.

Another object of the present invention is to provide a source module connectable to such item treatment containers, in which the source module functions to create and push a drying or treating air flow stream which can be channeled into the container and through the chambers within the container.

A related additional object of the present invention is to provide an external source module including one or more system for generating a forced air flow stream to be connected to and moved through the chambers within the container, wherein such source module also includes a system for heating such an air flow stream, and/or for adding sanitizing materials to such an air flow stream, and/or for adding odorizers to such an air flow stream.

Another object of the present invention is to provide a drying container with an air flow stream inlet, which can be directly or indirectly attached to a source module.

Another object of the present invention is to provide a system for routing and recycling exhaust air, which exits the chambers back into the container system.

Yet another object of the present invention is to provide a source module that is capable of forcing air into an air flow stream inlet of the container and through the connected chambers within the container.

Yet another object of the present invention is to provide a source module that is capable of pulling an air flow stream through the connected chambers within the container.

Another object of the present invention is to provide methods for drying to-be-treated-items within a series of connected chambers of a portable sports equipment container by using a system of interconnected chambers that control and channel the desired quality, quantity, velocity, and direction of a drying and/or treating air flow stream through a series of to-be-dried and/or to-be-treated-items, wherein interconnected chambers form a virtual tube for an air flow stream, and whereby further the virtual tube separates and supports the to-be-treated-items while maintaining them in series within the virtual tube within the container.

As detailed below, the present invention relates to apparatus in the form of a container having two or more interconnected chambers for carrying and treating a plurality of similar or diverse to-be-treated-items with a circulating air flow stream. The air flow stream is preferably heated air for drying and/or otherwise taking care of to-be-treated-items. In preferred embodiments the container includes a plurality of interconnected chambers that are designed to serially receive and pass-along a circulating air flow stream. The container and the chambers within the container are for storing and/or transporting a plethora of articles, such as sporting equipment and athletic clothing. For example, the to-be-treated-items may be damp or wet cloth or clothing, and especially sports clothing, undergarments, towels, sporting goods, hockey gear, football gear, lacrosse gear, soccer gear, shoes, skates and the like. Clearly, substantially any and all other articles of clothing, cloth and equipment that are of appropriate size may be stored and dried or otherwise treated in the chambers of the container of the present invention. Such articles are collectively referred to herein as "to-be-treated-items". More specifically, and as detailed below, the present invention provides such container systems in which the interconnected chambers may be perceived as forming a virtual tube for serially receiving an air flow stream for drying and or otherwise treating to-be-treated-items within the chambers. Of unique significance, such virtual tube has a total length in excess of any single exterior or interior length dimension or width dimension or height dimension of the container. As explained below, such multiple interconnected chambers forming a virtual tube are often, of necessity, organized in a tortuous pattern within a container or as a container. The addition of odorizing, and sanitizing materials, along with and carried by the treating air flow stream is also taught.

Of additional significance is the fact that each chamber provides a surface or support for supporting to-be-treated-items. It follows that multiple interconnected chambers provide multiple surfaces or supports for supporting a plethora of to-be-treated-items far in excess of any single interior length dimension or width dimension or height dimension of a single chamber or of an entire container. In view of the multiple supporting surfaces or elements so provided by multiple interconnected chambers, to-be-treated-items can be placed in each of the multiple chambers in an orderly and uncluttered manner to thereby allow each item to be treated with an air flow stream without being unduly blocked or unnecessarily covered by other items, thereby allowing for more efficient and complete treatment by the air flow stream.

The container of the present invention includes an inlet opening and an outlet or exhaust opening. The interconnected chambers, whether or not in the form of a virtual tube, are between such an inlet opening and outlet or exhaust opening. The inlet opening may, but preferably does not, include prior art devices such as manifolds, diffusers, fans, injection tubes, or louvers, and does not require any of those mechanisms for its operation. The air flow stream is blown or pumped into the inlet opening or pulled through the exhaust opening and through the interconnected chambers within the container, whether or not in the form of a virtual tube. As noted above, and in more detail below, the air flow stream may be heated and odorized, and may contain a sterilizing or sanitizing agent.

In one preferred embodiment an attachable and detachable source module is provided. As used herein, a "source module" includes a unit for generating an air stream flow, such as a fan, and may also include a heating element through which the air stream flow may be passed and heated, and/or a source for providing sterilizing or sanitizing material such as ozone, and/or a odorizing source.

The chambers that form the virtual tube of the present invention are connected in a manner such that they are open to the inlet, and thence in series or in parallel to each adjacent one or more chambers and finally to an exhaust outlet. As detailed below, the individual chambers are individually accessible, and allow the to-be-treated-items to be placed on the supporting surfaces or elements therein in a manner such as to not limit the exposed surface area of each to-be-treated-item, and the to-be-treated-items are preferably not bunched together or placed in a manner that will block the passage of the treating air stream flow through each chamber, or from chamber to adjacent chamber. In use, the treating air flow stream will pass from the inlet and through each adjacent chamber in turn. The size and design of each chamber and of the container is such that substantially the entire volume of treating air can pass through and/or around to-be-treated-items supported within each of the chambers.

The virtual tube formed from the two or more adjacent chambers is always longer than any single length dimension, width dimension or height dimension of the container, and the supporting surfaces or elements are always in excess of any single interior length dimension or width dimension or height dimension of a single chamber or of an entire container. The treating air flow stream travels through the entire length of the chambers forming the virtual tube and is then expelled out of the container. As detailed below, in some preferred embodiments the treating air flow stream is recycled back to the inlet for reuse.

The structure of the treating system of the present invention allows for a large number of connected chambers capable of having a treating air stream flow traveling serially or in parallel between them, and being limited only by the volume of the chambers and the container in which the chambers are placed. As detailed below non-air stream flowing chambers may be attached to the container of the present invention.

As noted above and detailed below, provision of a source module to propagate a treating air flow stream into and through the connected chambers within the container provides ambient substantially dry air stream flow or heated air flow stream for drying, and if desired sanitizing and/or odorizing materials for treatment of to-be-treated items carried within the chambers of the container. A container of the present invention may be placed on top of or adjacent such a source module. The source module includes or may be used with a tube or other connecting element that inserts into an inlet opening or an outlet opening of the container. When placed on the source unit, the weight of the container will normally be capable of sealing the connection between the source module and the container. The connection allows the treating air stream flow to be pushed directly into the container and thence through the serially connected chambers.

A source unit also preferably includes control switches and may include one or more timer. For example, one such timer could control the blowing and heating time of the source module. A second timer could control the sanitizing and/or odorizing time of the source module. Once the container is placed adjacent to or on top of the source module with a connecting device, such as a tube inserted into the inlet or outlet of the container, the user has only to activate the source module, for example, with a switch or a timer switch to dry and/or to sanitize and/or to odorize the to-be-treated-items in the chambers of the container. It is also noted that the source module can be designed to be powered by any art known AC or DC power source, or by a combination of both.

These and other objects of the present invention will become apparent to those skilled in the art from the following detailed description and accompanying drawings, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings, which are incorporated in and form a part of this specification, illustrate complete preferred embodiments of the present invention according to the best modes presently devised for the practical application of the principles thereof, and in which.

Figure 11:
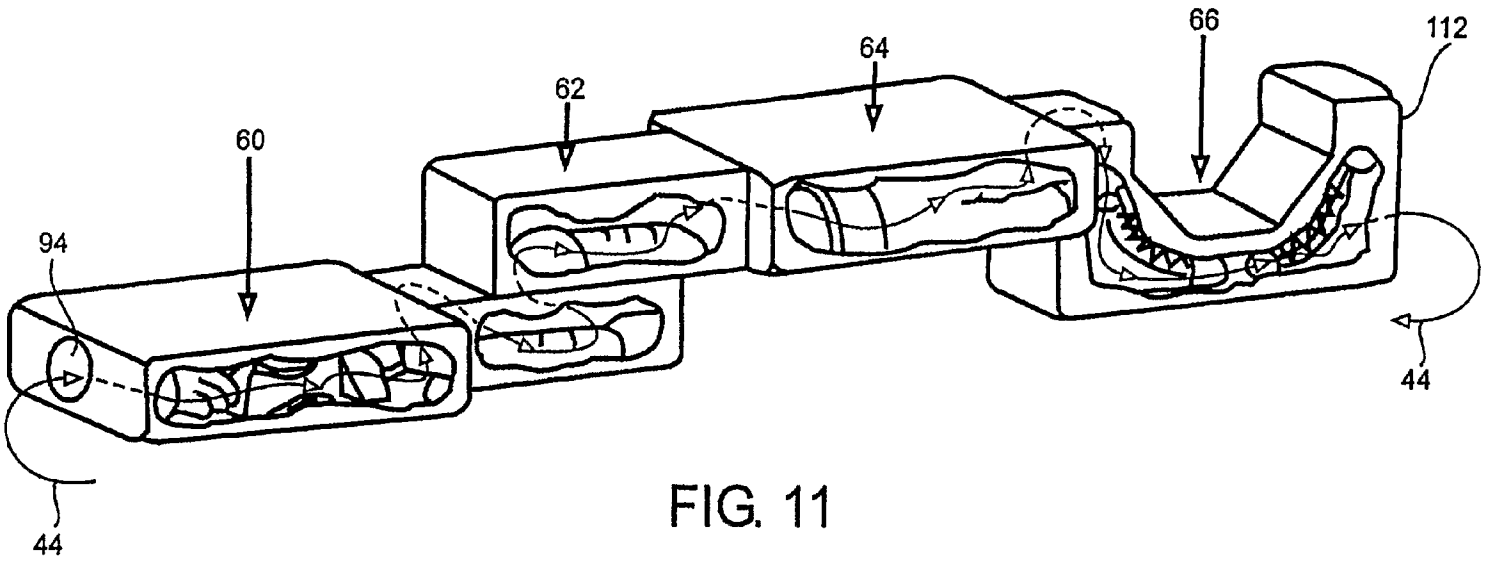
FIG. 11 shows a perspective partially cut away view of the chamber carrying portions of the container of FIGS. 4-10 illustrating what those chamber carrying portions would look like if physically aligned end to end to form a virtual tube with air flow passing therethrough.
Figure 12:
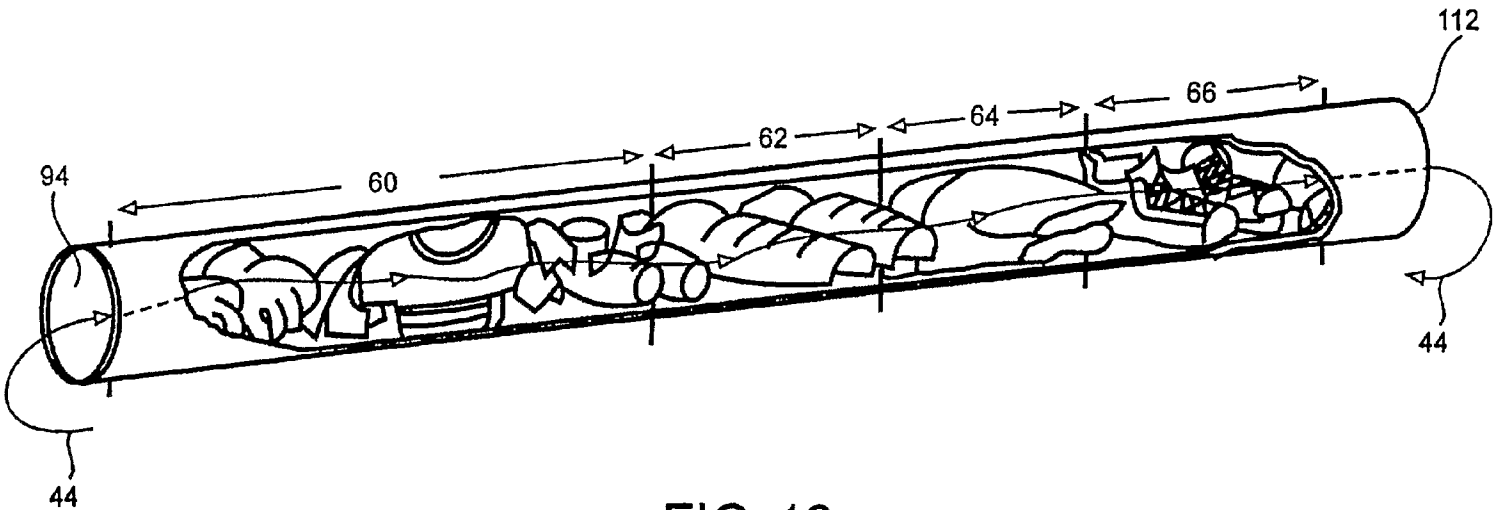
Figure 13:
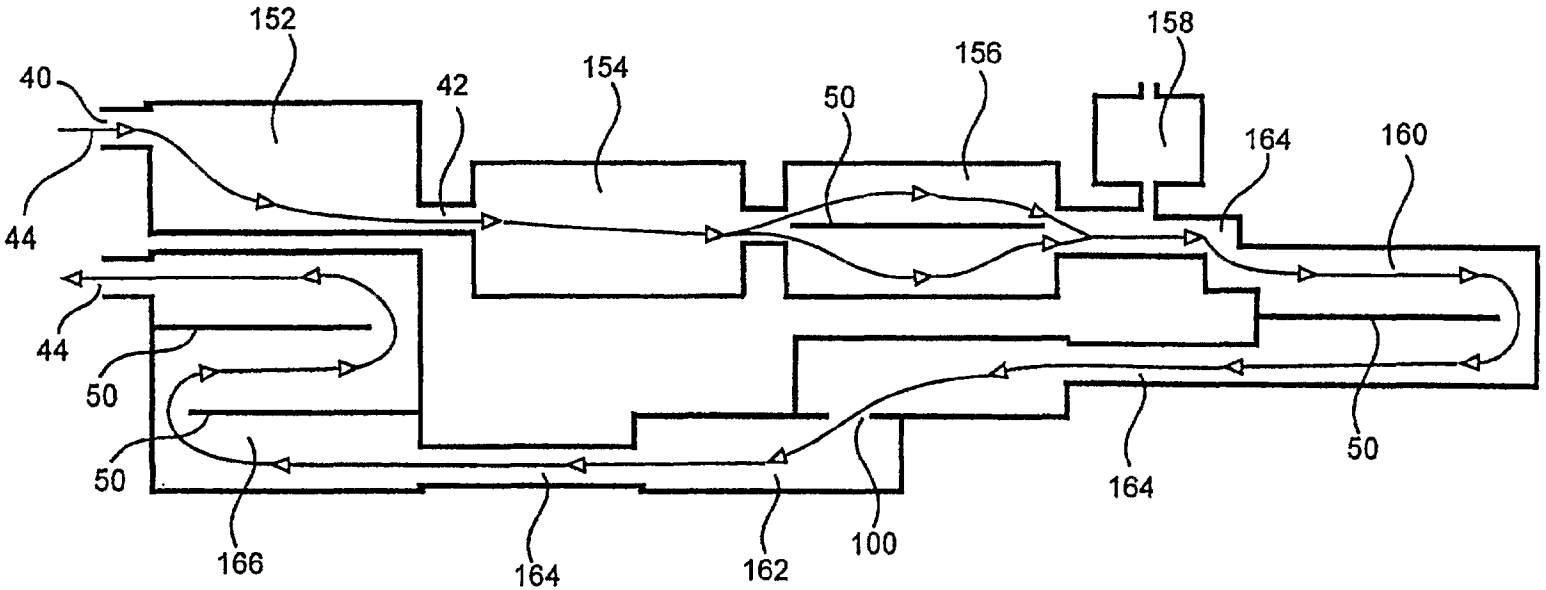
Figure 14:
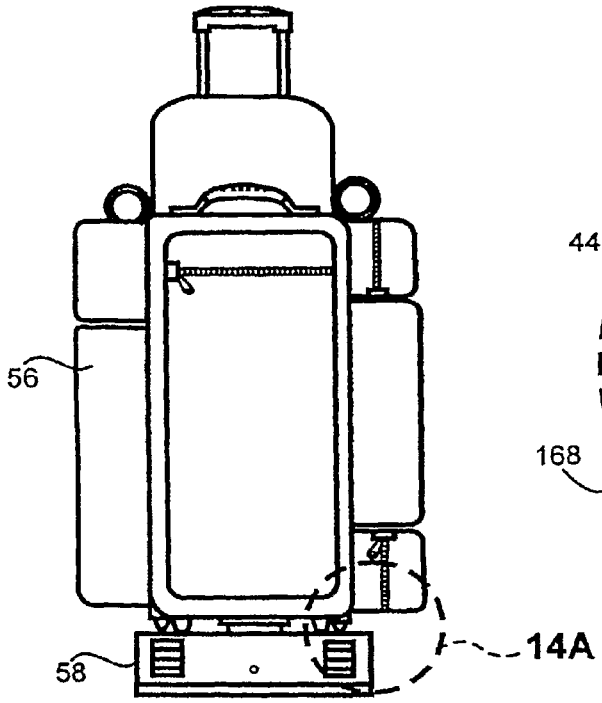

FIG. 12 is a perspective partially cut away exaggerated view equivalent to FIG. 11, and representing what FIG. 11 would look like as an actual tube with air flow passing therethrough;

FIG. 13 illustrates a schematic representation of a complex drying system according to the present invention, and in which the drying system functions as a virtual tube, when functionally applied and assembled within a container or to form a container;

FIG. 14 shows a front view of the container of FIGS. 4-10 mounted on a source of treating air flow, and with the air exhaust outlet located adjacent to the a source of treating air flow to mix exhaust air with fresh air.

Figure 14A:
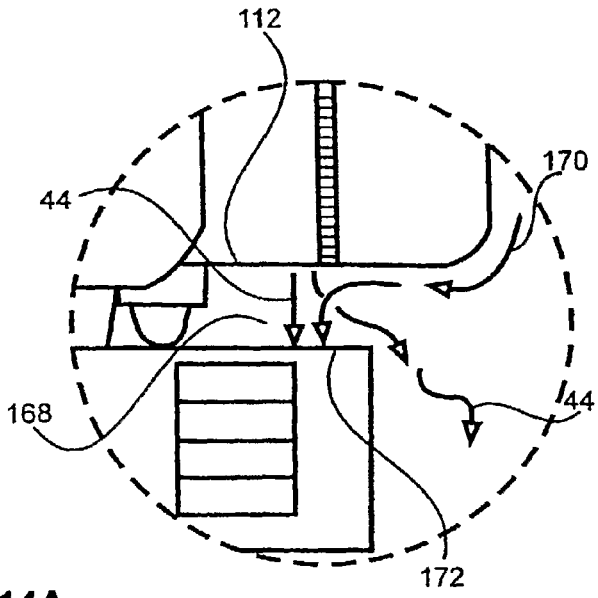
Figure 15:
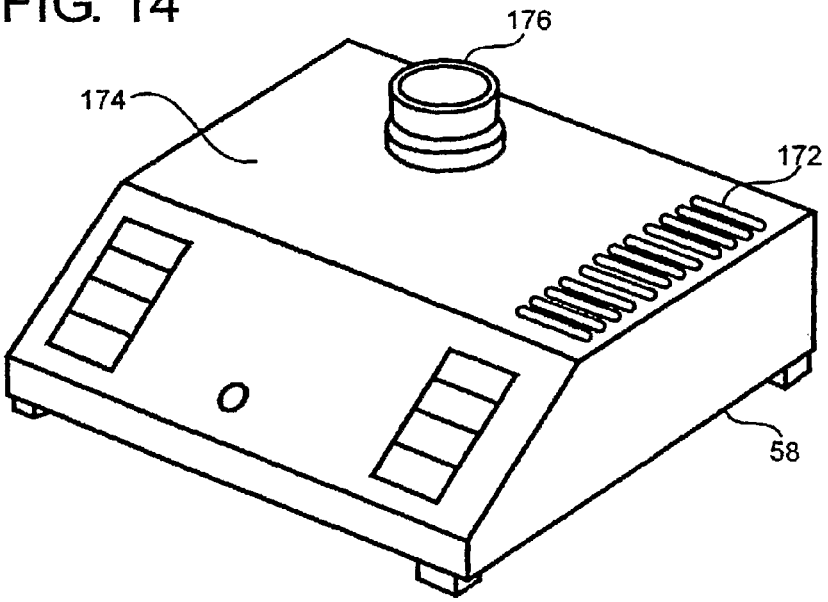
Figure 16:
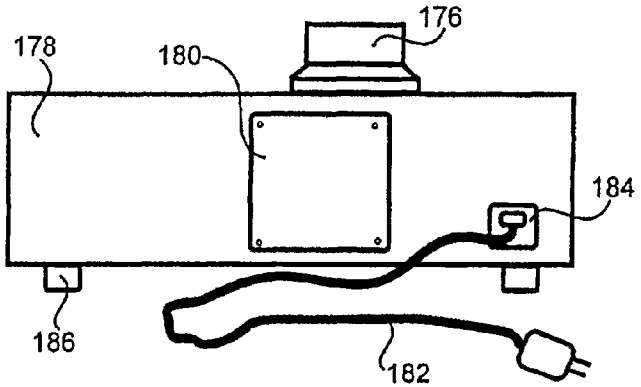
Figure 17:
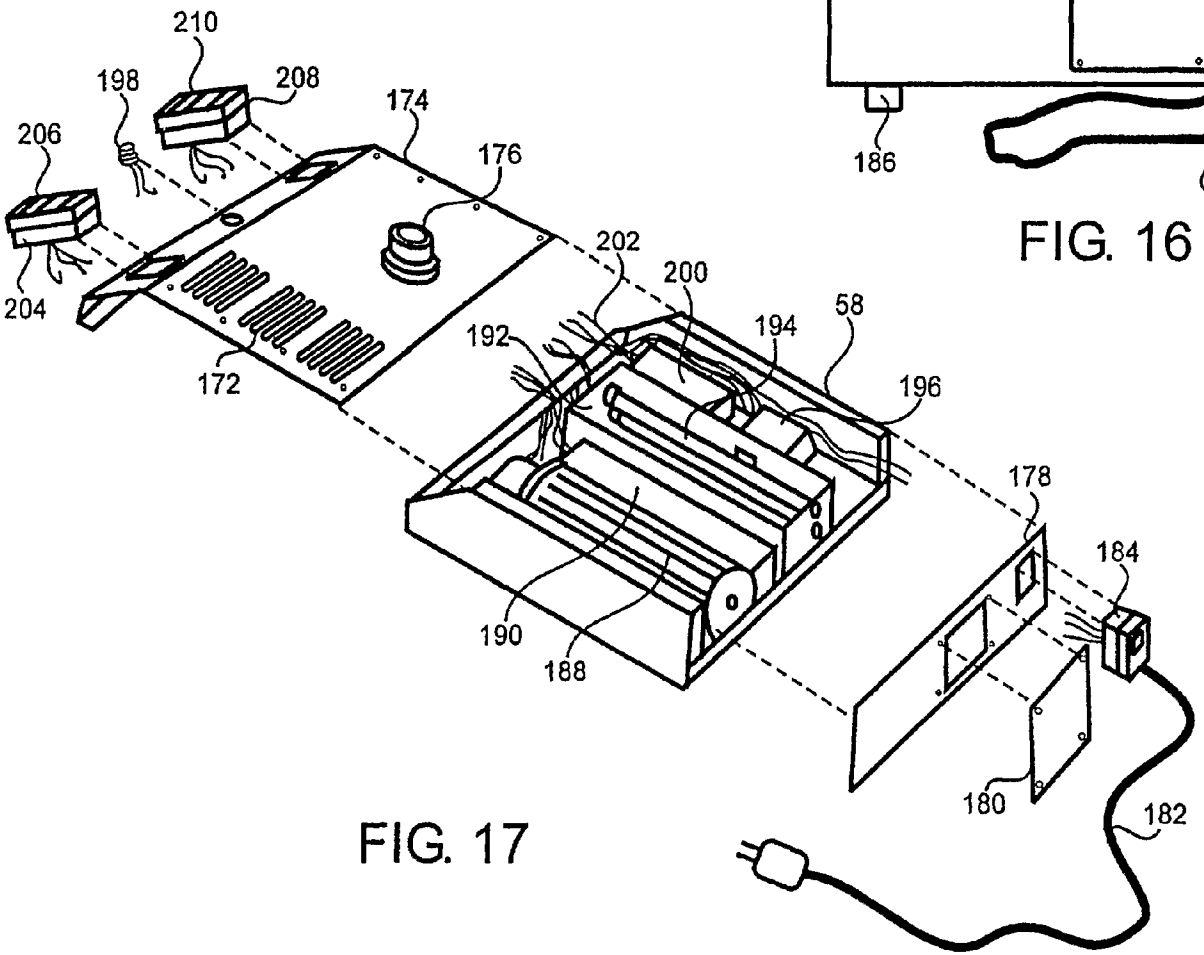

FIG. 14A shows a magnified view of the air mixing area 14A-14A of FIG. 14, and illustrating the mixing of exhaust and fresh air at the inlet of the source of treating air;

FIG. 15 shows an enlarged front perspective view of the source of treating air;

FIG. 16 shows back elevational view of the source of treating air;

FIG. 17 shows a side perspective view of source of treating air, revealing the internal components of the source of treating air;

DESCRIPTION AND DISCUSSION OF THE PRIOR ART

Figure 1:
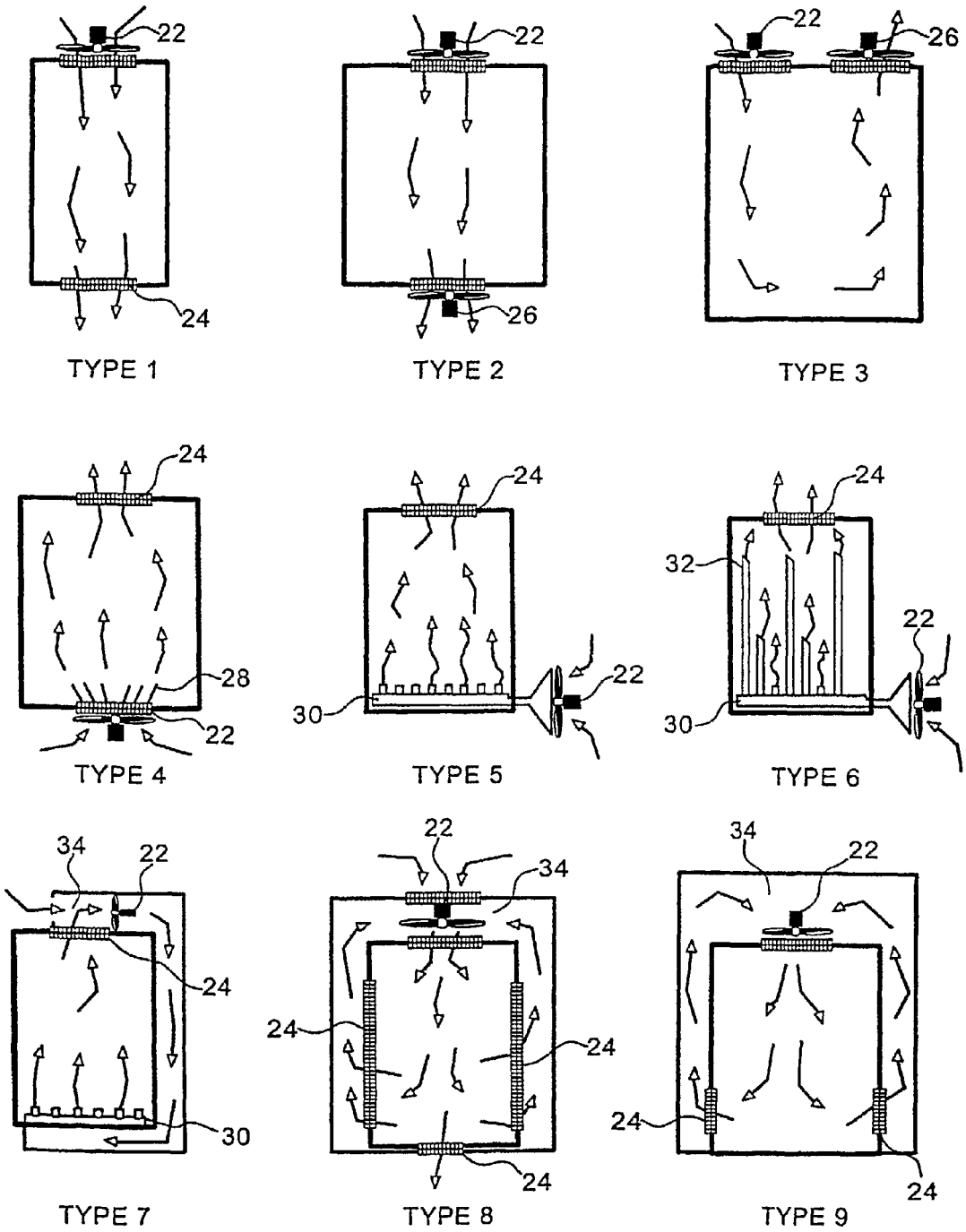
FIG. 1 PRIOR ART
FIG. 1 diagrammatically shows cut away image of nine examples of prior art drying systems.

FIG. 1 diagrammatically shows examples of nine typical prior art drying systems. They have been grouped into three basic families of drying mechanisms. The first group of these prior art drying systems, as shown in Type 1, Type 2, and Type 3, use only fans to direct air within and through a drying chamber, and have limited surface area on which to rest to-be-treated-items. The second group of these prior art drying systems, as shown in Type 4, Type 5, and Type 6, use louvers, manifolds, diffusers, and air injection methods to spread or diffuse the air within the drying chamber, and have limited surface area on which to rest to-be-treated-items. The third group of these prior art drying systems, as shown in Type 7, Type 8, and Type 9 use fans, as in the first group, plus associated chambers to capture the initially circulated air, and then uses a mixing chamber for re-circulating all or part of the initially circulated drying air and/or odorizing air and/or sanitizing agent back into the main treatment chamber, and have limited surface area on which to rest to-be-treated-items.

In Type(s) 1, 2, and 3 a drying chamber is clearly defined and the air movement within the drying chamber is controlled by the placement of an air flow stream input fan and/or an exhaust fan. Type 1 is representative of Pajak U.S. Pat. No. 5,528,840 in which there is a single air flow stream input fan 22 and a single passive air flow stream outlet 24. Once the air leaves fan 22 in the inlet, the velocity and direction of the drying air is poorly controlled as it passes to-be-treated-items (not shown) until it is exhausted at opposed outlet 24. Type 2 is representative of LaPorte U.S. Pat. No. 6,263,591 in which there has been an attempt to improve the velocity and direction of the air flow stream by adding a fan 26 at the opposed exhaust outlet. Finally, in this series, in Type 3, exemplified for example in Dhaemers U.S. Pat. No. 5,369,892 (FIG. 6), the movement of the air flow stream from fan 22 is redirected back toward the inlet side of the chamber by exhaust fan 26. In all three cases, once the air flow stream leaves the inlet of the container it is subject to being blocked, slowed and diverted by any to-be-treated-items (not shown) within the drying chamber. The air flow stream may be channeled in the wrong direction by any to-be-treated-items (not shown) in the drying chamber, thus creating dead air spaces that reduce the effectiveness of the drying air. Also, the addition of exhaust fans in Type(s) 2 and 3 undesirably increases the cost of those units.

In Type(s) 4, 5 and 6, there are several different structures and methods for diffusing and dispersing the air flow stream as it is moved into the drying chamber. In Type 4, exemplified in Brotherton U.S. Pat. No. 4,812,621, louvers 28 have been added to the inlet to force the air flow stream to spread out in the container. In Type 5, as exemplified by Dhaemers U.S. Pat. No. 6,134,806 (FIG. 18), a manifold/diffuser 30 is placed in the bottom of the container to spread the air flow stream as it enters the chamber. In Type 6, exemplified in Lipscy U.S. Pat. No. 5,987,773, inlet tubes 32 have been added to a manifold 30. Inlet tubes 32 work as injectors to place the air where it is desired within the drying chamber. Although diffusing and injecting the air flow stream improves how the air comes in contact with the to-be-treated-items; unfortunately, by diffusing the air, the quantity of air that comes in contact with each to-be-treated-item is reduced by the amount of diffusion. Also, once the drying air leaves the diffuser/injector it is uncontrolled and subject to being blocked or slowed by the to-be-treated-items. The cost of the extra equipment required to diffuse the air flow stream adds unnecessary cost to the price of the apparatus.

In Type(s) 7, 8 and 9 several different methods of recycling all or part of the warm drying treating air flow stream or sanitizing agent back into the treating chamber are shown. In Type 7, exemplified in Dhaemers U.S. Pat. No. 5,369,892 (FIG. 22), the treating air is pumped from fan 22 to the bottom of the treating chamber by a closed conduit that is located outside of the treating chamber to a bottom inlet manifold/diffuser 30. After passing through the chamber, the air exits through exhaust port 24 and is recaptured within a partially ventilated mixing chamber 34. The recaptured air is then pumped or drawn back into the conduit for reuse. In Type 8, exemplified in Dhaemers U.S. Pat. No. 5,546,678 (FIG. 19), the air is blown into the treatment chamber that has multiple outlets 24. One of the outlets exhausts to the atmosphere, while the others exhaust through porous walls into conduits that travel outside the drying chamber back to the inlet fan 22. There is an internal mixing chamber in which fresh air and recycled air combine to form an air flow stream that is then blown into the drying chamber. In Type 9, exemplified in Dawson U.S. Pat. No. 5,666,743 (FIG. 4), all of the treating air is captured and recycled. The walls of the treating chamber are vented to allow exhaust air to pass into conduits that travel outside the drying chamber back to the inlet fan 22.

In view of this typical prior art, it will be seen that there is a need for treating systems to provide a solution to the aforementioned problems and limitations by providing structures and operations that can, for example, using a single fan that moves a single treating air flow stream through a series of serially connected chambers, thereby resulting in an efficient, inexpensive, uncomplicated drying and sanitizing structure and operation, having a series of connected chambers of a container, by using a system of baffles and interconnected chambers that control and channel the desired quality, quantity, velocity, and direction of a drying air flow stream toward and through a series of to-be-treated-items, wherein the baffles and interconnected chambers form a virtual tube for an air flow stream, whereby the virtual tube separates and supports the to-be-treated-items while maintaining them in series or in parallel within the virtual tube within the container. In addition, there is a need for treating systems that provide greater amounts of surface area or support elements on which to support to-be-treated-items. As a point of reference, none of the nine drying systems set forth diagrammatically in FIG. 1 meet this criteria, or falls within the teaching or the claims of the present invention.

DETAILED DESCRIPTION OF THE INVENTIONS

Figure 2A:
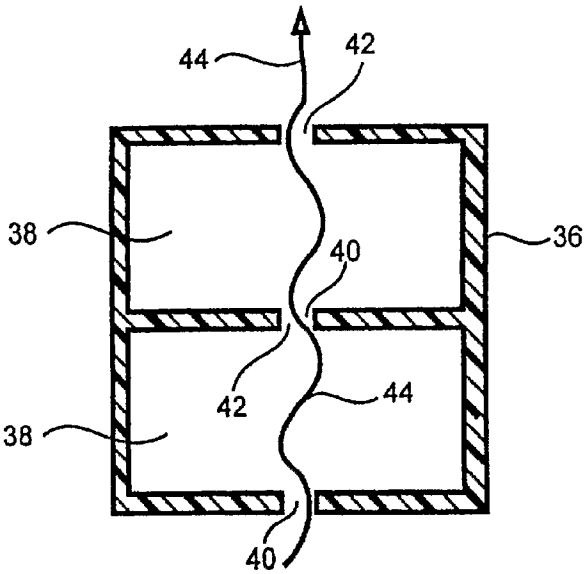
FIG. 2A diagrammatically shows a cut away image of a drying system that is similar to the present invention, but which does not fall within the teaching or claims of the present invention.

In the accompanying drawings like reference characters designate like or corresponding parts in the several drawing figures. As a follow on to the teaching of the diagrammatic representations of the prior art in FIG. 1, a diagrammatic representation of a drying system that does not fall within the teaching or claims of the present invention is set forth in FIG. 2A. Despite the fact that the drying system set forth in FIG. 2A consists of a container 36 carrying a plurality of adjacent interconnected drying chambers 38, in this case two chambers, with each chambers 38 designed to carry one or more to-be-treated-items (not shown) and having an air flow stream inlet opening 40 and an air flow stream outlet opening 42. However, container 36 of FIG. 2A does not define a virtual tube that has a length of travel for the air flow stream 44 in excess of any single length dimension or width dimension or height dimension of container 36, and therefore container 36 of FIG. 2A does not fall within the teaching or claims of the present invention.

Figure 2B:
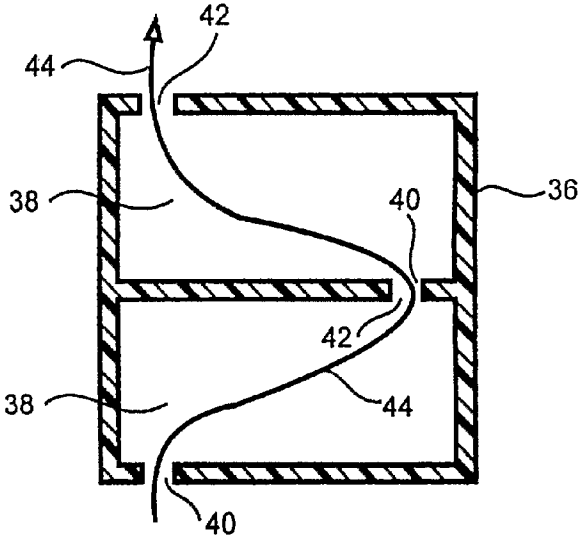
FIG. 2B diagrammatically shows a cut away image of a simple drying system similar to that of FIG. 2A, that does fall within the teaching and claims of the present invention.

By contrast, the diagrammatic representation of a drying system set forth in FIG. 2B does fall within the teaching and claims of the present invention. In this representation the drying system set forth in FIG. 2B also consists of a container 36 carrying two adjacent interconnected drying chambers 38 that are each designed to carry one or more to-be-treated-items (not shown). Each chamber 38 includes an air flow stream inlet opening 40 and an air flow stream outlet opening 42, much as in FIG. 2A. However, in the embodiment of FIG. 2B each chamber 38 has an air flow stream inlet opening 40 and an air flow stream outlet opening 42 that are offset from one another, so that, as shown, the common walls between each of the chambers 38 acts as a baffle for the air flow stream 44. The system therefore does define a virtual tube for the air flow stream 44 that has a length of travel in excess of any single length dimension or width dimension or height dimension of container 36, and does fall within the teaching and claims of the present invention.

Figure 3A:
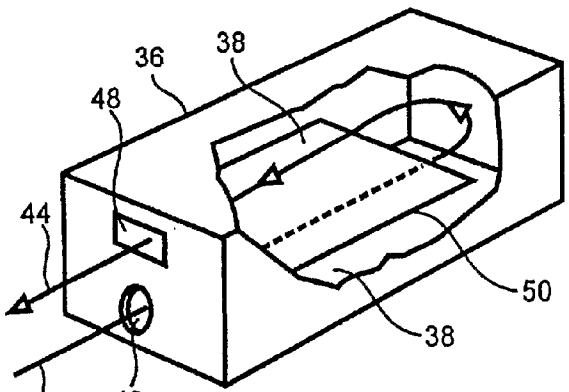
FIG. 3A diagrammatically shows a perspective, partially cut away image of yet another simple drying system, similar to that of FIG. 2B, that also falls within the teaching and claims of the present invention.
Figure 3B:
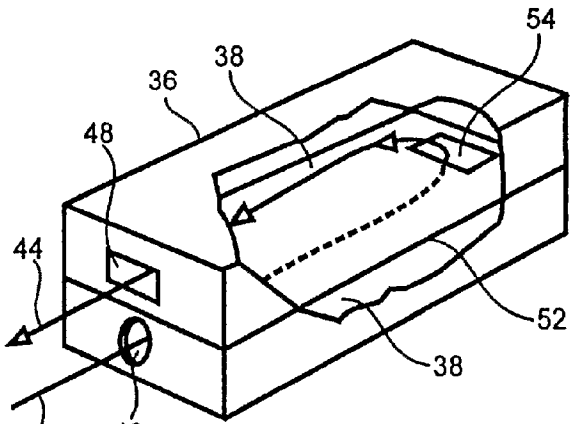
FIG. 3B diagrammatically shows a perspective, partially cut away image of yet another simple drying system, similar to that of FIG. 3A, that also falls within the teaching and claims of the present invention.

FIGS. 3A and 3B provide two additional diagrammatic representations of simplified embodiments of the present invention. As shown in FIG. 3A, a three dimensional oblong container 36 is shown in a partially cut away perspective view. As shown, container 36 has five closed exterior walls, and an end wall that has an open air flow stream inlet 46 and an open air flow stream outlet 48. In this embodiment a divider 50 is secured to the end wall and between two adjacent side walls. It can be seen that divider 50 functions to define two treating chambers 38 within container 36, wherein each treating chamber defines a discrete area of volume within container 36. Each of the treating chambers 38 being in air stream flow connection, in series, to the adjacent chamber and to an air flow stream inlet 46 and to an air flow stream outlet 48. As such, divider 50 functions as a baffle to control air flow stream 44, so that after air flow stream 44 enters air flow stream inlet opening 46 it traverses through first treating chamber 38 to the opposed end of container 36 and thence around divider/baffle 50 and back through second treating chamber 38, and then exits through air flow stream outlet opening 48. It is seen once again that this system defines a virtual tube for air flow stream 44, in which the virtual tube defines a length of travel for air flow stream 44 in excess of any single length dimension or width dimension or height dimension of container 36.

Now referring to FIG. 3B, another three dimensional oblong container 36 is shown in a partially cut away perspective view. As shown in this version, container 36 again has five closed exterior walls, and an end wall that also has an open air flow stream 44 inlet 46 and an open air flow stream outlet 48. However, in this embodiment a divider 52 is secured to both end walls and between two adjacent side walls so that it functions to define two substantially separate treating chambers 38 within container 36, wherein each treating chamber defines a discrete area of volume within container 36. Treating chamber 38 is placed in air flow stream 44 connection, in series, to the adjacent chamber 38 for air flow stream 44 contact through an opening 54 in divider 52. In this embodiment, each treating chamber 38 is in air flow stream 44 connection in series to the adjacent chamber and to an air flow stream inlet 46 or to an air flow stream outlet 48. As such, divider 52 functions as a baffle to control air flow stream 44, so that after air flow stream 44 enters air flow stream inlet opening 46 it traverses through first treating chamber 38 to the opposed end of container 36 and thence around divider/baffle 52 and back through second treating chamber 38, and then exits through air flow stream outlet opening 48. It is seen once again that this system defines a virtual tube for air flow stream 44, which virtual tube defines a length of travel for air flow stream 44 in excess of any single length dimension or width dimension or height dimension of container 36.

Figure 4:
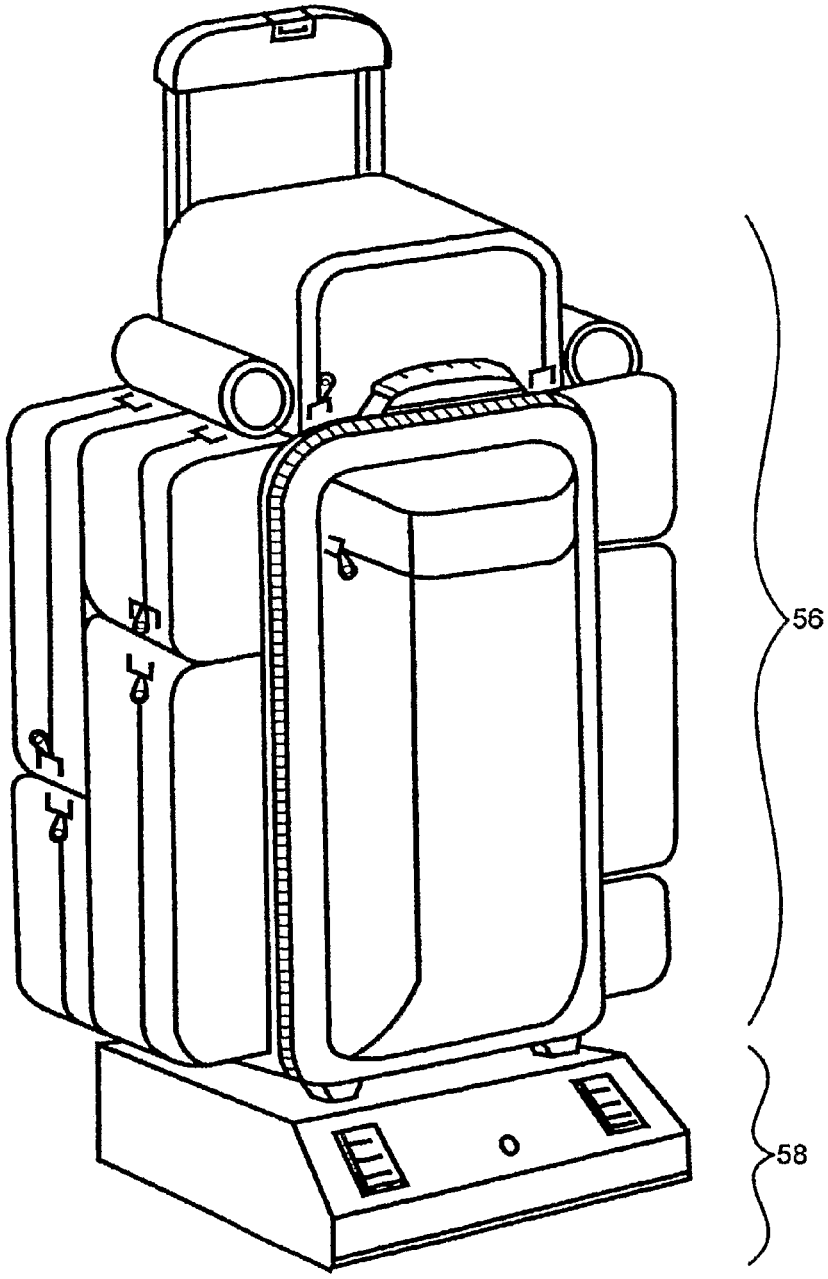
FIG. 4 shows a front perspective view of a preferred embodiment of the present invention in which a drying unit container rests upon and is in operative connection with a source of treating air flow stream.

FIG. 4 shows an external perspective view of a preferred embodiment of a carrier bag container 56, of the present invention, assembled with all of its attachments, and resting on a source module 58 of the present invention. Carrier bag container 56 represents a preferred embodiment of container 36, discussed earlier and shown diagrammatically in FIGS. 2B, 3A, and 3B. In this preferred embodiment, carrier bag container 56 is designed as a sports equipment bag for carrying and treating hockey equipment, and may include detachable treating chambers and non-treating chambers. The details of the structure and operation of carrier bag container 56 and of source module 58 are set forth below.

Figure 5:
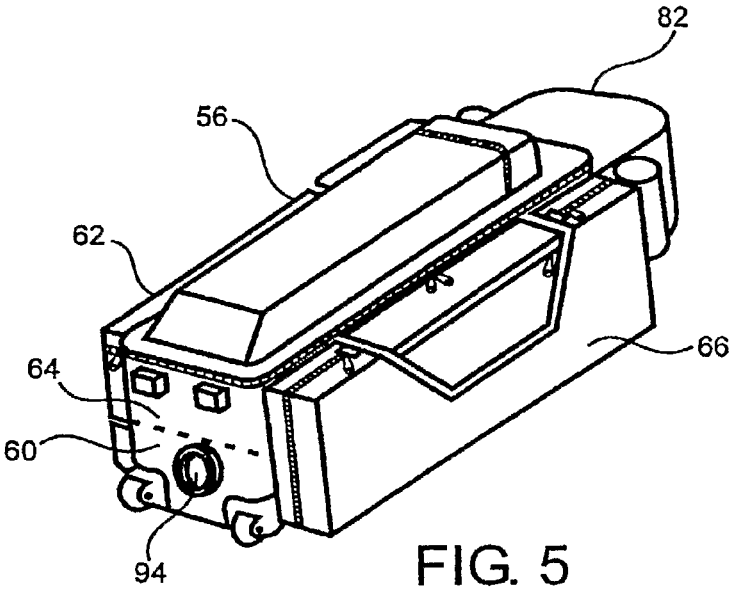
FIG. 5 shows a reduced perspective view of the drying unit container of FIG. 4 rotated into a horizontal position, but with the source of the treating air flow stream removed.

FIG. 5 shows a reduced perspective view of the fully assembled sports equipment carrier bag container 56 of FIG. 4, still assembled with all of its attachments, and rotated into a position as it would appear if resting in a horizontal position on a supporting surface, say a floor, table, bench or the like. For practical purposes, in this preferred embodiment, carrier bag container 56 is shown as carrying detachable and non-detachable non-treating storage chambers.

Figure 6:
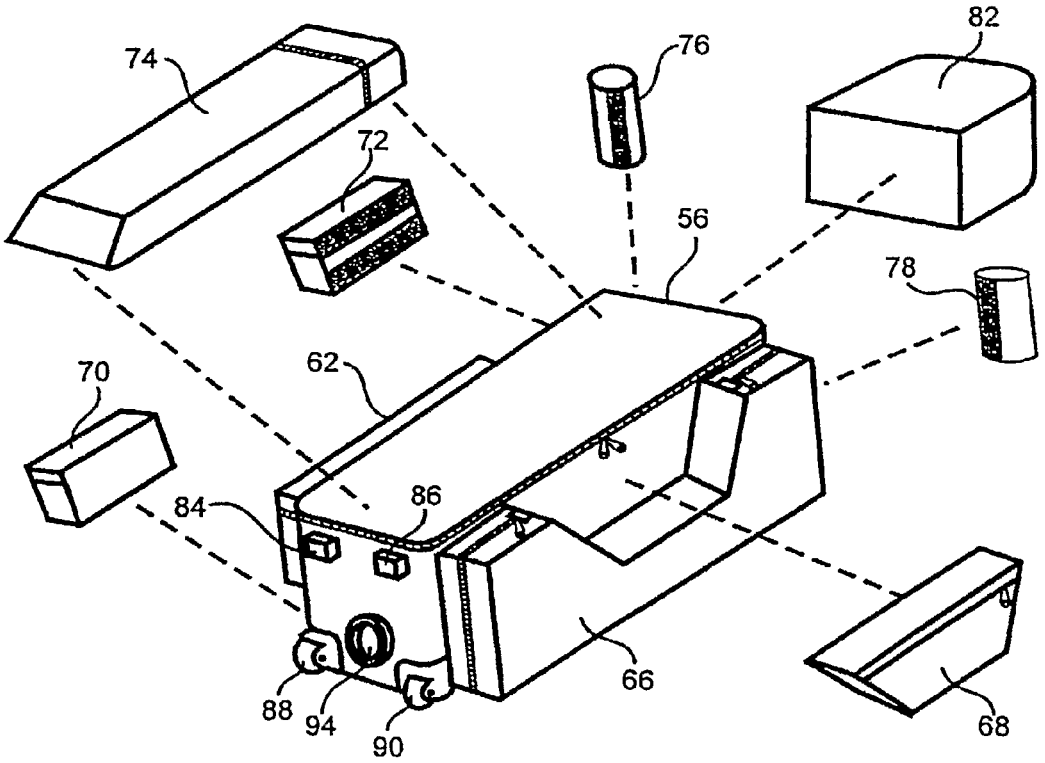
FIG. 6 shows a perspective view similar to FIG. 5, but with certain non-treating storage chambers totally shown in exploded view.

In FIG. 6 certain non treating detachable/non-detachable storage chambers are shown in exploded view to show them more clearly, and to reveal the underlying chamber carrying portions of carrier bag container 56. Non-treating non-detachable storage chambers include a relatively large storage chamber 68 shown on the right side of the bag and 74 shown on the top of the bag, and one relatively smaller storage chamber 70 shown on the lower left side of the bag. Also shown on the left side of the carrier bag container 56 is a detachable non-treating container 72. In the preferred embodiment 72 is a removable tool bag that is removably attached to carrier bag container 56 by hook and loop material. These non-treating detachable/non-detachable storage chambers do not have an air flow stream inlet or outlet, and for example, may be used to hold items not requiring drying or sanitization or other treatment, i.e. keys, glasses, cell phones and the like (not shown). In a related manner, cylindrical, open, detachable, non-treating holders 76 and 78 do not have an air flow stream inlet or outlet, and are used for example to hold water bottles. Other attachments to carrier bag container 56 can be designed to hold other not to-be-treated-items, i.e. bottles, hockey sticks, rackets, and the like.

Additionally, a non-treating, normally non-detachable helmet storage chamber 82 is provided. In preferred embodiments helmet storage chamber 82 is lined with a padded material (not shown) to prevent damage to the helmet during transport. Helmet storage chamber 82 is positioned so that it may optionally be included in the virtual tube series. While not shown in this embodiment, treating air flow stream 44 can be added into helmet storage chamber 82 by simply adding some conduit passages between the adjacent chamber carrying portions and the helmet chamber 82. Helmet storage container 82 may also be made as a detachable compartment while still retaining the option of including it in the virtual tube. Hook and loop material could be used to removeably attach helmet chamber 82 to chamber carrying portions 38 of carrier bag container 56.

Circumferential hook and loop material around the conduit connections is adequate to seal conduit passages leading from and to the chamber carrying portions 38, thus allowing 82 to function as an additional chamber carrying portion when connected to carrier bag container 56. Wheels 88 and 90 are provided on the bottom of carrier bag container 56 to allow carrier bag container 56 to be rolled, much like conventional modern luggage. Front support legs 84 and 86 provide support and balance to carrier bag container 56 when standing in an upright position.

Figures 7, 8:
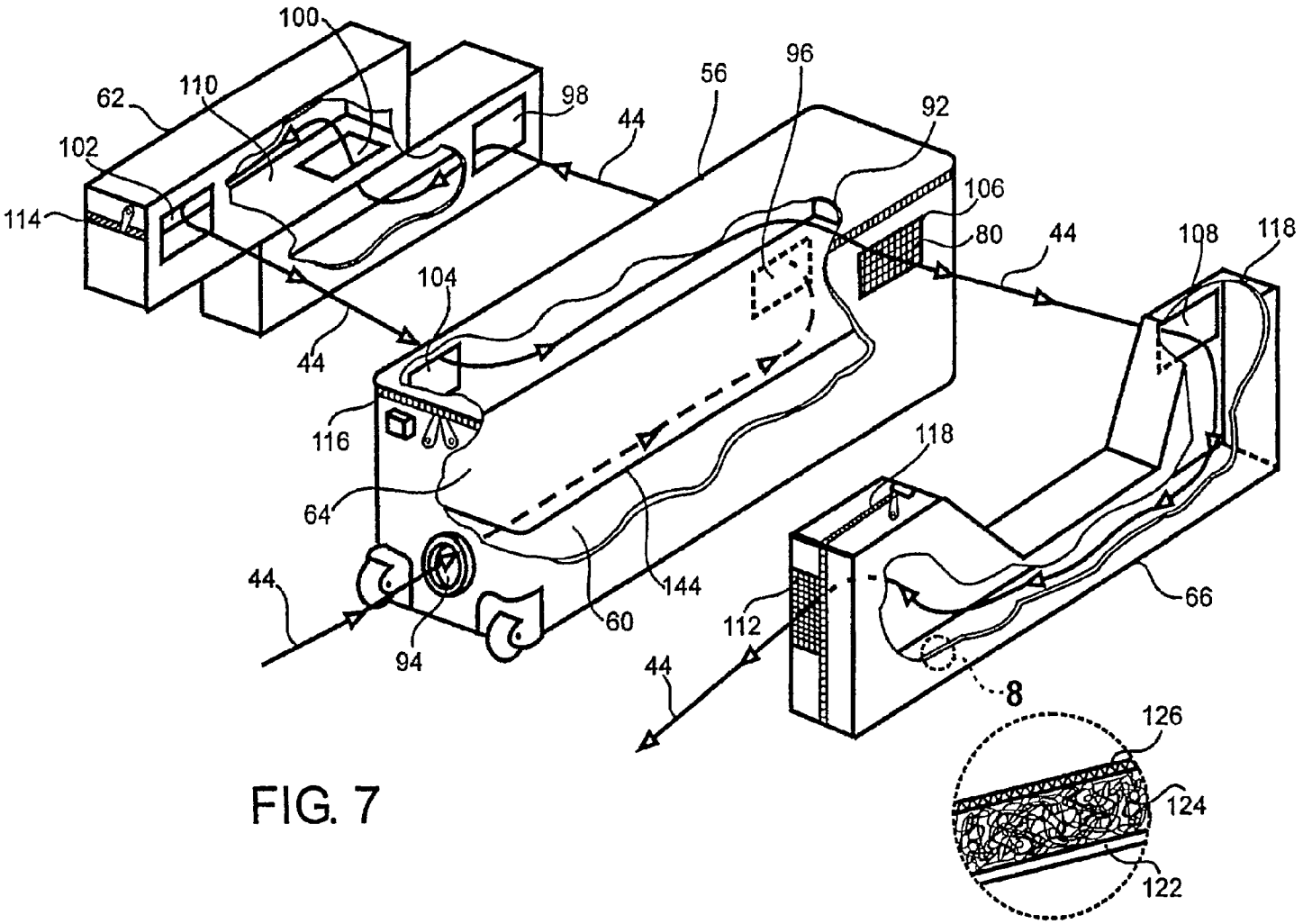
FIG. 7 shows an exploded perspective view similar to but slightly larger than FIG. 6 and with non-treating storage chambers completely removed and diagrammatically illustrating the path of a treating air flow stream; through the chamber carrying portions of the container.
FIG. 8 shows a magnified cross-sectional view of sidewall portion 8-8 of FIG. 7.

In FIG. 7 there is shown an exploded view with non-treating storage chambers 68, 70, 72, 74, 76 and 78 completely removed from carrier bag container 56. Helmet compartment 82 has also been removed, thus making it easier to view and understand the functional treating chamber carrying portions within carrier bag container 56.

As now illustrated in FIG. 7, sports equipment carrier bag container 56 of FIG. 6 is shown in a disassembled view with normally interconnected chamber carrying portions 60, 62, 64, and 66 separated, and shown in a simple, substantially exploded view arrangement with one another. Although, this also represents the mode in which each chamber carrying portion would or could be positioned when inserting or removing to-be-treated-items into each chamber carrying portion. Each chamber carrying portion 60, 62, 64, and 66 has an open air flow stream 44 inlet 40, represented in this embodiment as 94, 98, 104 and 108, and an open air flow stream 44 outlet 42 represented in this embodiment as 96, 102, 106, and 112. Air flow stream inlet 46 and air flow stream outlet 48, as shown earlier in FIGS. 3A and 3B, are exemplified in this embodiment as air flow stream inlet 94 and air flow stream outlet 112, respectively. As stated earlier, carrier bag container 56 exemplifies container 36. The chamber carrying portions may be used to hold to-be-treated-items requiring drying or sanitization or other treatment, for example to hold hockey clothing and equipment, as detailed below.

In addition, FIG. 7 shows an exploded view, partially cutaway, of the preferred embodiment and showing the direction of travel of the air flow stream within chamber carrying portions 60, 62, 64 and 66. In operation, treating air flow stream 44 passes into chamber carrying portion 60, through inlet 94. In the preferred embodiment chamber carrying portion 60 contains sub-components (not shown); an inlet guard 138, mesh divider screen 136, and entry zipper 128. These sub-components do not functionally affect the air flow stream 44, and have been removed in FIG. 7 to show more clearly how air flow stream 44 passes through chamber carrying portion 60. These sub-components are thoroughly illustrated and described below. The air flow stream 44 passes through the lower level chamber carrying portion 60, out of conduit passage 96 and into conduit passage 98 of chamber carrying portion 62. The location of conduit passage 96 is visible through cutaway 92. Conduit passages 96 and 98 form a mated pair that are joined in air flow stream 44 contact when carrier bag container 56 is assembled, as shown in FIG. 5.

Treating air flow stream 44 then passes into interconnected chamber carrying portion 62. The chamber carrying portion is accessible through zippers 114. In this embodiment chamber carrying portion 62 is subdivided by a divider panel 110 that helps keep its contents supported in a lower and an upper section. Divider panel 110 has a conduit passage 100 that allows the treating air flow stream 44 to pass from the lower section of chamber carrying portion 62 to the upper section of chamber carrying portion 62. Divider 110 is preferably comprised of a durable fabric, and while it divides chamber carrying portion 62 into two sub-chambers, these two sub-chambers essentially function as one chamber for drying purposes because conduit passage 100 allows air flow stream 44 to flow through them with little resistance. Divider 110 may also be made of a permeable mesh fabric that will allow treating air flow stream 44 to pass from the lower section of chamber carrying portion 62 to the upper section of chamber carrying portion 62, thus functionally replacing conduit passage 100. It is here noted that the divider panel 110 which subdivides chamber carrying portion 62 is not required for the virtual tube operation of the present invention. The divider panel 110 is placed in chamber carrying portion 62 because, as taught below, fairly heavy hockey kneepads will be placed in chamber carrying portion 62. Divider panel 110 provides additional support for the heavy kneepads during movement of carrier bag container 56. Therefore, divider panel 110 could be removed, or changed without affecting the operation of the present invention.

The treating air flow stream 44 then passes out chamber carrying portion 62 through outlet 102 and then in inlet 104 into chamber carrying portion 64, which in this embodiment is above chamber carrying portion 60. Conduit passages 102 and 104 form a mated pair that are joined in air flow stream 44 contact when carrier bag container 56 is assembled, as shown in FIG. 6.

After treating air flow stream 44 enters through conduit passage 104, it then passes into and through interconnected chamber carrying portion 64. Chamber carrying portion 64 is accessible through zipper 116. After treating air flow stream 44 travels through chamber carrying portion 64 it exits via conduit passage 106. Air flow stream 44 enters chamber carrying portion 66 through conduit passage 108 which forms a mated pair with conduit passage 106 when carrier bag container 56 is assembled, as shown in FIG. 6. In preferred embodiments, an air flow permeable mesh screen 80, as shown in FIG. 7, is included in one or both conduit passages 106 and 108 to prevent to-be-treated-items from blocking or being blown through passages 106 and 108.

Similarly, if desired, all air passages between chamber carrying portions can be constructed with a mesh screen to prevent stored to-be-treated-items from blocking or being blown through the passages. Treating air flow stream 44 travels the length of chamber carrying portion 66, and is then is exhausted from carrier bag container 56 through conduit passage outlet passage 112. As further disclosed below, chamber carrying portion 66 is designed to serve as the ice skate carrying chamber. As shown, chamber carrying portion 66 has two opposing mirror image sections, one to accommodate each skate. As illustrated access zippers 118 are placed on each end of chamber carrying portion 66 in order to facilitate the handling and positioning of each of the relatively large, heavy and sharp bladed skates into chamber carrying portions 66.

FIG. 8 shows a magnified view of a portion 8-8 of a preferred embodiment of a typical sidewall of a chamber carrying portion, in this case chamber carrying portion 66 of FIG. 7. As illustrated, the outermost wall 122 is a constructed of a substantially non-porous durable material. Adjacent to and inward from outermost wall 122 is a middle layer 124, a porous breathable material such as light weight open cell foam or open fiber matting material. Adjacent to and inward from middle layer 124 is an inner wall 126. Inner wall 126 is a porous material, such as mesh fabric, and protects and supports middle layer 124. This typical sidewall foam allows air flow stream 44 to easily pass in and out and through the porous material of middle layer 124. While middle foam layer 124 may have slightly more air resistance than the chamber carrying portions, it allows air flow stream 44 to bypass any blockage that may occur in a chamber carrying portion. Although the porous open middle layer 124 is porous, it has more air resistance than chamber carrying portions, and therefore the bulk of the drying air flow stream 44 will predominately flow through the chamber carrying portions, and only passes into and through porous middle layer 124 when it is occluded from a chamber carrying portion by a blockage or increased air resistance in the chamber carrying portion. This same type of layered structure may be used to allow air flow stream 44 to flow through or around any and all chamber carrying portions to avoid blockage in the chambers and/or to eliminate dead air space in any chamber. Depending on what is being treated in each chamber, the entire length of each chamber can be lined with such a layered structure, or with equivalent breathable material.

Figure 9:
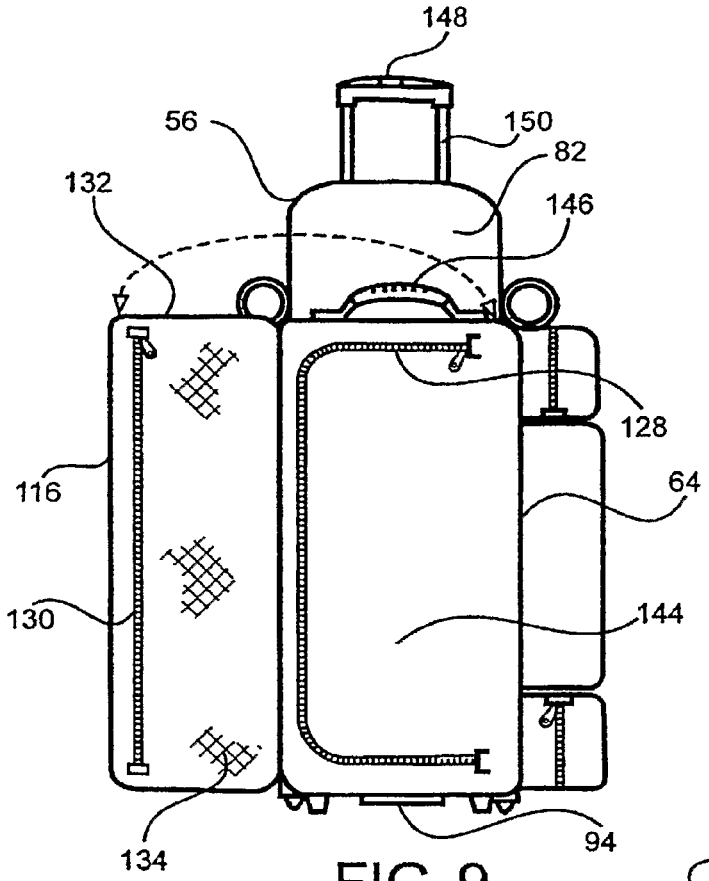
FIG. 9 shows a front elevational view of the inside of the center carrying portion of a container of the present invention shown in an upright position with a zipper closure unzipped, and the covering flap opened and swung away to the left to reveal the inside of the three dimensional center chamber carrying portion designed to receive to-be-treated-items.
Figure 10:
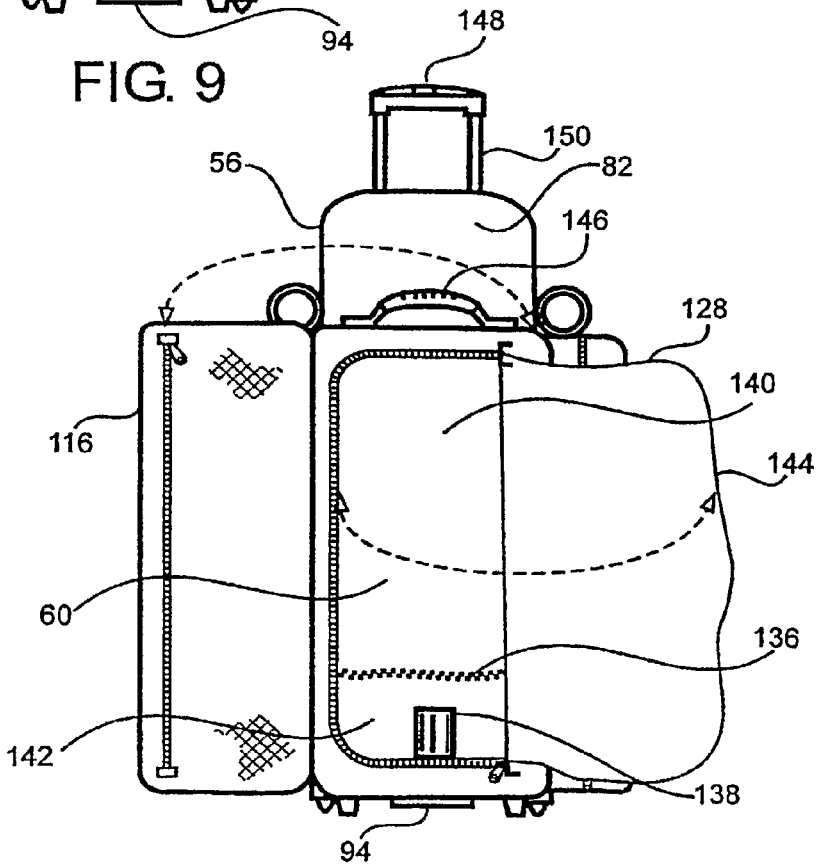
FIG. 10 shows a front elevational view of the inside of the center carrying portion of the container of FIG. 9, but shows a right side compartment entry flap with a zipper unzipped and opened to the right to reveal the inside and the further depths of the three dimensional center chamber carrying portion designed to receive to-be-treated-items.

In FIGS. 9 and 10 equipment carrier bag container 56 is shown in an upright perspective position with zipper 116 of compartment 64 unzipped, and entry flap 132 opened and swung away to the left to reveal the inside of three dimensional chamber carrying portion 64. As shown, the chamber carrying portions in both 60 and 64 are accessible through zippers 128 and 116. Also shown is a clothing drying compartment mesh divider screen 134 with a zipper 130 for accessing to and opening of entry flap 132 of compartment 64. This is a long flat sub-compartment that is designed for drying hockey gear or clothing such as jerseys and socks.

FIG. 10 is similar to FIG. 9, but shows compartment entry flap 144 with zipper 128 unzipped and opened to the right to expose the inside of chamber carrying portion 60. Inlet blockage guard 138 is located over inlet 94 in the side of chamber carrying portion 60 to protect inlet 94 from blockage and also block to-be-treated-items from passing through inlet 94. Divider 136 is preferably comprised of permeable mesh fabric, and while it divides chamber carrying portion 60 into two sub-chambers 140 and 142, these two sub-chambers essentially function as one chamber for air flow stream purposes because the air permeable divider allows air flow stream 44 to flow through sub-chambers 140 and 142 with little resistance.

Handle 146, is a general lifting handle, while telescopic pulling handle 150 allows a user to pull carrier bag container 56 on wheels 88 and 90, as shown in FIG. 6, much like conventional modern luggage. Telescopic handle 150 can be retracted or can be extended to a locked position by pressing handle release 148. In this embodiment handle 150 automatically locks, when positioned into the retracted or extended position using a state-of-the-art spring activated lock mechanism. Telescopic handle 150 is located behind helmet storage chamber 82.

As illustrated, this entire system defines a virtual tube for air flow stream 44, in which the virtual tube defines a length of travel for air flow stream 44 in excess of any single length dimension or width dimension or height dimension of carrier bag container 56.

To further clarify and illustrate the virtual tube concept of the present invention, referring to FIG. 11, partially cut away carrying portions 60, 62, 64, and 66 of carrier bag container 56 are shown rotated and reconfigured in a substantially linear fashion to clearly virtually show how the four main chamber carrying portions are serially connected for purposes of lengthening the movement of air flow stream 44 through the virtual drying tube so that it has a length of travel in excess of any single length dimension or width dimension or height dimension of carrier bag container 56.

To further illustrate the concept that the chamber carrying portions 60, 62, 64, and 66 are the equivalent of a virtual tube, FIG. 12, is the exaggerated equivalent of FIG. 11, represented as it would look as an actual tube. Also, typical to-be-treated-items of hockey gear and equipment are illustrated and visible through the partial cutaways in each chamber carrying portion illustrated in FIGS. 11 and 12. Chamber carrying portion 60 is shown as carrying, for example, cloth items such as gloves, elbow pads, shoulder pads, stockings and a jersey. The offset portions of chamber carrying portion 62 are shown as carrying, for example, combined knee and leg pads, chamber carrying portion 64 is shown, for example, as carrying cloth pants, and chamber carrying portion 66 is shown as carrying, for example, skates. It will first be noted that other to-be-treated-items and totally different equivalent items may be placed in each chamber carrying portion shown in this configuration of carrier bag container 56, or in any other configuration of carrier bag container constructed in accordance with the teaching of the present invention.

As shown earlier in FIG. 7, input drying and/or sanitizing and/or odorizing air flow stream 44, hereinafter "treating air flow stream 44," is shown passing through inlet 94 of carrier bag container 56, and thence serially into and through each of the interconnected chamber carrying portions 60, 62, 64, and 66, and then exits through outlet 112. In the method of operation of this system, the treating air flow stream 44 through tube shaped chamber carrying portions 60, 62, 64, and 66, as shown, treats all of the to-be-treated items in the same manner in the real life sinuous configuration of the assembled carrier bag container 56.

With the forgoing structure and operation in mind, it will be understood that if damp or wet to-be-treated items, such as hockey athletic gear, is placed in a chamber carrying portion of the present invention in its actual carrier bag container 56 configuration, it will be functionally the same as placing it in a virtual tube, such as those shown in FIGS. 11 and 12. The to-be-treated items can be placed in series and not bunched together with more surface area of the gear exposed to the drying air flow stream 44, and dead air spaces will be minimized. The athletic gear placed within the continuous drying chamber of the preferred embodiment virtual tube of the present invention is dried in virtually the same manner as if the gear was placed in a straight tube such as shown in FIG. 12. It is seen that the length of the virtual tube formed within carrier bag container 56 by chamber carrying portions 60, 62, 64, and 66 is always in excess of any single length dimension or width dimension or height dimension of carrier bag container 56. It is further seen that the treating system of the present invention provides greater amounts of surface or supports on which to place to-be-treated-items.

The method and apparatus of the present invention allows for substantially any number of connected chamber carrying portions 38, as shown in FIG. 2B, carrying an air flow stream 44. So, for example, FIG. 13 illustrates a schematic representation of a drying system according to the present invention in which the drying system is a virtual tube, when functionally applied and assembled in a preferred embodiment, and is folded within a container or to form a container 36, and that the length of that virtual tube is in excess of any single length dimension or width dimension or height dimension of that container 36. FIG. 13 illustrates some of the various ways that the air flow stream 44 can be channeled through chamber carrying portions 38, as needed or desired to create or form container 36 with multiple interconnected chamber carrying portions 38, in serial or in parallel, air channels and conduit passages 54, and baffles 50. The design of the chamber carrying portions and resulting air flow stream 44 is determined by the drying requirements and shapes of the to-be-treated-items and the desired final shape and size of container 36.

Now again referring to FIG. 13, chamber carrying portion 152 is an example of a container carrying portion with an offset inlet 40 and outlet 42, such as those illustrated in FIGS. 2B and 3A. Chamber carrying portion 154 is an example air flow stream 44, exemplified in the first part of carrier bag container 56 in chamber carrying portion 60 in which the air flow stream enters through inlet 94 and passes through divider panel 136. Chamber carrying portion 156 is an example of a chamber carrying portion with a non-permeable divider placed in the path of air flow stream 44, in which it is desired to divide and then recombine air flow stream 44. The chamber carrying portion is divided into two sub-chamber carrying portions within container 36 by placing a baffle 50 in the middle of the chamber carrying portion 156, which internally divides and recombines air flow stream 44.

Further in FIG. 13, chamber carrying portion 158 illustrates that some portion of the air flow stream 44 can be released into an auxiliary chamber to treat to-be-treated-items, that do not need to be in a main chamber carrying air flow stream 44, without weakening the desired integrity and effectiveness of air flow stream 44. This structure and method may be used, for example to add treating air to a parallel compartment such as helmet compartment 82 instead of including that compartment in the virtual tube created by the chamber carrying portions as previously illustrated and described.

Referring again to FIG. 13, chamber carrying portion 160 illustrates an example of the use of a baffle 50 to change the direction of the air flow stream 44, in the same manner illustrated by FIG. 3A. Chamber carrying portion 162 is an example of offset chamber carrying portions 38. An offset chamber carrying portion 38 with an interconnecting air channel opening, is illustrated by air channel opening 54 in divider 52 of chamber carrying portion 62 of carrier bag container 56. Although not taught by that embodiment, air channels 164 can be used to connect chamber carrying portions 38 to maintain a continuous air flow stream 44. Because of the complications involved with locating the virtual tube chamber carrying portions within a container or to form a container a not to-be-treated-item bearing air channel that can pass an air flow stream 44 may be required between chamber carrying portions 38 that are not adjacent to each other, but that are still within container 36. Finally chamber carrying portion 166 illustrates how multiple baffles 50 can be used to direct the air flow stream 44, in this embodiment in a serpentine pattern 166. It is therefore seen that FIG. 13 shows one, but only one, schematic embodiment of how complex such a virtual drying tube of the present invention can be.

Carrier bag container 56, resting atop the source module 58, is shown with an air mixing chamber 168, in FIG. 14. The mixing area 168 is the space between exhaust opening 112 and holes 172 of source module 58. This is shown more clearly in enlarged view FIG. 14A. The purpose of the mixing area is to allow fresh air or freshly treated air 170 to mix with the exhaust air flow stream 44. This can allow, for example, already heated and/or sanitizing and/or odorizing air, in air flow stream 44, to be recaptured and re-circulated through the article treating system. The amount of recycled air is determined by how close exhaust opening 112 is placed to inlet holes 172 of source module 58. The benefit of recycling the exhaust air flow stream 44 is the efficient re-use of the heated and sanitized air. Any undesirable odors from the treated-items, say from athletic equipment, that may be released into the ambient air are minimized by recycling the exhaust air flow stream 44. Increasing or decreasing the space between exhaust opening 112 and holes 172 of source module 58 controls the amount of exhaust air that mixes with ambient air. If necessary the exhaust opening 112 and inlet 172 could be directly connected and completely re-circulate the treated air flow stream 44. The preferred distance is determined during the design of the system of the present invention; however, an adjustable version may be provided. Air mixing chamber 168 is an optional feature that can be used when ever there is a benefit to capturing and reusing all or part of the previously treated exhaust air.

Now referring to FIG. 14 again, this embodiment provides a method for routing the exhaust air or sanitizing agent back into the carrier bag container 56 inlet by using the system of baffles and/or interconnected chambers of the virtual tube to cause treating air flow stream 44 to be routed back toward inlet holes 172 of source module 58. The exhaust treated air flow stream 44 and/or sanitizing ozone mixes with the ambient air and then is recycled into source module 58 for additional treatment and then for injection into carrier bag container 56. It is noted that exhaust air in air flow stream 44 could be filtered, for example using an activated charcoal filter or state-of-the-art filters placed at open air flow stream outlet 112 to trap undesirable odors before releasing treated exhaust air into the environment. It should also be noted that all air passages between chamber carrying portions could be constructed with filters, if desired.

It is noted that although carrier bag container 56 which has been described above is optimized for hockey gear and equipment, other containers and configurations of serially attached chamber carrying portions organized may be designed using the basic principle of the provision of a virtual tube that has a length of travel for a treating air flow stream that is in excess of any single length dimension or width dimension or height dimension of the container that carries the virtual tube.

As detailed below, connection of source module 58 to carrier bag container 56, as first shown in FIG. 4, provides a preferred starting point for creating treating air flow stream 44. Air flow stream 44 is injected through air flow stream inlet 94 of carrier bag container 56 for treatment of to-be-treated-items carried within chamber carrying portions 60, 62, 64, and 66 of container 56. As noted above, and as further discussed below, treating air flow stream 44 may supply drying ambient air, and/or drying heated air, and/or sanitizing air, and/or odorizing air, and/or combinations thereof from source module 58, or from equivalent sources, to the contents of container 56.

Source module 58 is shown in an enlarged perspective view in FIG. 15. In the preferred embodiment shown, source module 58 and container 56 are sized and designed so that container 56 may be placed and/or stored on top of source module 58, see FIGS. 4 and 14. Source module 58 includes an extended cylindrical tube 176 that is sized and designed to insert into and make a substantially air tight connection with air flow stream inlet receptacle 94 on the bottom of the container 56. As designed and shown, the weight of the container 56 substantially seals the connection between the source module fixture tube 176 and air flow stream inlet 94 of container 56. When in operation, and as discussed below, fixture tube 176 allows the injection of treating air flow stream 44 directly into and through chamber carrying portions 60, 62, 64, and 66 of container 56.

A rear view of source unit 58 is shown in FIG. 16. A back panel 178 is shown as a part of source module 58, and a rear access panel 180 is also shown on back panel 178. A power cord 82 for source module 58 is connected through back panel 178 by combined surge protector and on/off switch 184. Skid resistant, for example rubber, feet 186 support the source module and keep it from slipping during use.

FIG. 17 shows an exploded view of source module 58 with top cover 174 removed to expose the external and internal components of source module 58 to view. There are a series of inlet through holes 172 on the top of cover 174. These inlet through holes 172 are the inlets for ambient air that is used to create air flow stream 44. Within source module 58 and under the air flow stream inlet 172 is located a blower fan 188. In the preferred embodiment shown, blower fan 188 is an electrically powered motorized centrifugal fan that draws ambient air into source module 58. In the preferred embodiment centrifugal fan blower 188 has an about 3-inch diameter fan blade, or equivalent, although in this and in other embodiments the blower and blade can be sized to meet the air flow stream 44 volume and/or velocity and/or pressure needs of any particular system.

As shown, adjacent to blower fan 188, within source module 58, is a heater unit 190 that may be used to heat air flow stream 44 after it is drawn in by blower fan 188. In the preferred embodiment of the present invention heater unit 190 is a two-element resistive heater that can produce variable amounts of heat, say 1,000 watts of heat during a drying cycle, of say 250 watts of heat during a sanitizing cycle or no heat during an odorizing cycle or during drying using only ambient air. Equivalent heaters or heaters that produce more or less heat can be utilized if different heating or drying requirements are needed. Heater unit 190 is connected to a plenum structure 192.

As shown, adjacent to heater unit 190 and within plenum 192, is housed a sanitizing unit 194. In this embodiment sanitizing unit 194 is a comprised of pair of bulbs that are designed to produce ultraviolet (UV) radiation which converts a portion of the oxygen in the incoming ambient air in their vicinity and in the air passing by them to sanitizing/germicidal ozone. When cover 174 is in place it shields the UV light to prevent a user from looking directly at the UV radiation, and thereby protects the eyes of a user. In addition to providing shielding from UV radiation, top cover 174 serves as the cover of the plenum to complete a channel for air flow stream 44. The air flow stream 44 channel increases its contact time and proximity with the UV radiation and the sanitizing ozone that is produced, as well as directing it toward outlet fixture tube 176. An odorizing unit 196 can also be connected to the plenum 192 to add a desirable scent, at the end of the drying or sanitizing cycle, carried via the air flow stream 44, to the to-be-treated-items within the chamber carrying portions. Charcoal or a state-of-the-art filter could also be placed in the air flow stream 44 channel of source module 58 to filter out undesirable odors. Should there be a problem, rear access panel 180 allows a user to reach and replace the UV light bulbs in sanitizing unit 194 inside source module 58.

A ballast unit 200, which serves to supply the correct current to the UV light bulbs, is located within source module 58. In addition, there is an indicator light 198 that indicates if the UV light bulbs are on. All of the electrical components within source module 58 are connected and interconnected to power cord 182 as necessary using state-of-the-art electrical wires, wire harness 202 and components. It should be noted that source module 58 could also be designed to operate using state-of-the-art DC as its input power source, or could be designed to use both AC and DC form different components. The ability to use DC power is advantageous, for example, when transporting the system of the present invention in an automobile.

In preferred embodiments, source module 58 includes two timers 204 and 208. For example, in this preferred embodiment timer 204 is for selecting the time for sanitizing and/or odorizing to be treated items, and second timer 208 is for selecting the time for drying to be treated items with ambient or heated air. In this embodiment, once container 56 is placed on top of source module 58, with fixture tube 176 inserted into inlet receptacle 94, the user only has to press a button 206 or 210, associated with timers 204 and 208 respectively, to initiate drying and/or sanitizing and/or odorizing to-be-treated-items in the chamber carrying portions 60, 62, 64, and 66 that form an extended length virtual tube in container 56.

First timer 204 can be a multiple hour timer, say a twelve-hour timer for example, with analog sub-time settings that are used to control the length of the sanitizing cycle, for example, while using a lower amount of heat and a slower air velocity while ozone saturated air is delivered for up to, say a 12-hour period. Second timer 208 is for the drying cycle using, for example, a high heat flow stream 44 supplied at a higher velocity for, say, about one hour. The length of the sanitizing or heating cycle can be changed as needed by calibrating timers 204 and 208 each for the desired time period. As previously noted, the drying and/or sanitizing and/or odorizing air flow stream 44 leaves source module 58 through cylindrical tube 176 that is inserted into air flow stream inlet receptacle 94 on the bottom of the container 56.

For ease of operation, timers 204 and/or 208 can be set prior to starting the treating process. It should be noted that timers 204 and 208 may be provided as either digital or analog timers with various configurations. The container 56 is left in place while the module is going through the drying and/or sanitizing cycles. The module shuts off automatically when the drying and/or sanitizing cycles are completed. The container 56 can be maintained on top of the module 58 until the next use.

It should also be noted that a variety of other modifications may be employed for the source module. For example, a pause/resume switch, not shown, could be added to control the cycles, if desired.

When appropriate or desired, source module 58 can also be connected indirectly to container 56. For example, as shown in FIGS. 18 and 19, via a hose or other type of hollow tube 212 attached between source module 58 and container 56. Now referring to FIG. 18 in more detail, there is illustrated a diagrammatic representation of a treating container 56 connected to source unit 58 or the like, by hose 212. In this embodiment source unit 58 pushes treated air via hose 212, into and through the chamber carrying portions of container 56, in the manner previously described. As shown, source unit 58, will include at least a blower unit 188, and may also include timers, heaters, sanitizers, odorizers, and the like as desired or required.

In FIG. 19 still another alternative embodiment of the present invention is shown as a diagrammatic representation.

In this embodiment the blower in source unit 58 is reversed so that it serves as a vacuum pump for drawing air out of inlet 94 through hose 212, to pull air in through inlet opening 96 and out of opening 94 of container 56.

It will be appreciated that in alternative embodiments, source unit 58 could be replaced by any art known or future equivalent blowing or drawing equipment such as a vacuum cleaner, hair dryer or any other mechanism that would push or pull air through container 56 and the chamber carrying portions.

Although the present invention has been described with reference to preferred embodiments, numerous modifications and variations can be made and still the result will come within the scope of the invention. No limitation with respect to the specific embodiments disclosed herein is intended or should be inferred.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

I claim:

1. An article for treating two or more to-be-treated items with a single contiguous treating airflow-stream, comprising:

a bag configured for storing, transporting, and protecting the to-be-treated items, said bag having at least one exterior bag inlet for receiving said single contiguous treating airflow-stream and at least one exterior bag outlet for exhausting said single contiguous treating airflow-stream, wherein said bag has a nominal internal length dimension and a nominal internal width dimension and a nominal internal height dimension;

a series of two or more chambers connected in airflow-stream series, said series of two or more chambers forming at least a portion of said bag, each said chamber having an interior defined by surrounding surfaces comprising substantially nonporous material and including at least one chamber inlet surface having a chamber airflow-stream inlet, and at least one chamber outlet surface having a chamber airflow-stream outlet, wherein the at least one chamber outlet surface of each chamber, except a last chamber in the series, is in airflow-stream connection with the chamber inlet surface of the following chamber, the series of two or more chambers including at least one chamber comprising a partial-air-bypass chamber, wherein at least a portion of a wall of the partial-air-bypass chamber consists essentially of:

an interior surface permeable to air;

an exterior surface substantially impermeable to air; and a spacing element comprising of an open cell foam between the interior surface and the exterior surface for forming a bypass space between the interior surface and the exterior surface;

wherein at least a bypass portion of the single contiguous treating airflow-stream passes through the permeable interior surface, through at least a portion of the bypass space, travels substantially parallel to the single contiguous treating airflow-stream, and back through the permeable interior surface, allowing the bypass portion of the single contiguous treating airflow-stream to bypass a blockage in the chamber and remain in airflow-stream connection with the outlet of the partial-air-bypass chamber;

wherein the chamber inlet surface of a first chamber in the series is connected to said at least one exterior bag inlet;

wherein the chamber outlet surface of the last chamber in series is connected to said at least one exterior bag outlet;

wherein the single contiguous treating airflow-stream entering said at least one exterior bag inlet passes through each chamber in series, via each chamber's respective inlet and outlet, and exits said at least one exterior bag outlet; and wherein said chambers define a virtual airflow-stream tube having a length in excess of at least the greatest of the nominal internal length dimension, the nominal internal width dimension, and the nominal internal height dimension of said bag, whereby to-be-treated items within any chamber are treated with the single contiguous treating airflow-stream.

2. The article of claim 1 further comprising a source for providing the single contiguous treating airflow-stream including:

a generator for generating the single contiguous treating airflow-stream;

a source inlet for acquiring source inlet air; the source inlet air comprising either ambient air, exhausted treating airflow-stream from the at least one exterior bag outlet, or a combination of the two;

a source outlet in airflow-stream connection to the at least one exterior bag inlet for directing the single contiguous treating airflow-stream into the at least one exterior bag inlet;

wherein the generated single contiguous treating airflow-stream flows through the two or more chambers connected in airflow-stream series to treat to-be-treated items.

3. The article of claim 2 wherein the source further comprises applying a treatment selected from the group consisting of: heating the single contiguous treating airflow-stream; creating and adding sanitizing substance to the single contiguous treating airflow-stream; and adding odorizing substance to the single contiguous treating airflow-stream.

4. The article of claim 2 wherein the source outlet is connected to the at least one exterior bag inlet with at least one of a hollow conduit; a means for placing the bag on top of the source and a means for connecting the at least one exterior bag inlet to the source outlet; a means for placing the source on top of the bag and a means for connecting the at least one exterior bag inlet to the source outlet; or a means for placing the source on a side of the bag and a means for connecting the at least one exterior bag inlet to the source outlet.

5. The article of claim 3 wherein the source further comprises means for controlling at least one of a time period when the source operates or a duration of treatment.

6. The article of claim 1 comprising at least three chambers, wherein at least one chamber is situated in parallel to the airflow stream series, the in-parallel chamber forming part of the virtual airflow-stream tube.

7. The article of claim 1 wherein the chambers are arranged such that the virtual airflow-stream tube forms a tortuous path.

8. The article of claim 1 wherein the interior of the chambers are separately accessible to allow to-be-treated items to be placed within the chambers.

9. The article of claim 1 wherein the interior of at least one chamber includes a mesh divider screen for further constraining and supporting the to-be-treated item within that chamber, and for preventing the to-be-treated item from shifting or being blown into or out of an airflow-stream inlet or airflow-stream outlet of that chamber.

10. The article of claim 1 wherein at least one chamber includes an inlet blockage guard positioned over at least a portion of the at least one exterior bag inlet to prevent blockage of the single contiguous treating airflow-stream.

11. The article of claim 1 wherein the at least one exterior bag inlet and the at least one exterior bag outlet are located in adjacent proximity to each other on a bottom side of the bag.

12. The article of claim 11 wherein the at least one exterior bag inlet and the at least one exterior bag outlet are located in such proximity that at least a portion of the single contiguous treating airflow-stream which exits the at least one exterior bag outlet is recaptured and routed into the at least one exterior bag inlet.

13. The article of claim 1 wherein the chambers are sized and shaped differently from each other in order to hold to-be-treated items of specific sizes, shapes, and materials.

14. The article of claim 13 wherein the chambers are sized and shaped to hold at least one of a helmet, clothing, protective gear, and equipment.

15. The article of claim 1, further comprising a handle attached to the bag and wheels attached to the bag in a manner to allow the bag to roll on the wheels when the handle is pulled or pushed.

16. The article of claim 1 wherein at least one non-airflowing chamber is attached to, or forms a portion of, the bag.

17. A system comprising:

a bag container for treating two or more to-be-treated items with a single contiguous treating airflow-stream, said bag container having at least one exterior container airflow-stream inlet and at least one exterior container airflow-stream outlet;

a series of two or more chambers connected in airflow-stream series, said series of two or more chambers forming at least one of said bag container or at least a portion of said bag container, each chamber having an interior defined by surrounding surfaces comprising substantially nonporous material and including at least one chamber inlet surface having a chamber airflow-stream inlet, which is in airflow-stream connection with said at least one exterior container airflow-stream inlet, and at least one chamber outlet surface having a chamber airflow-stream outlet, which is in airflow-stream connection with said at least one exterior container airflow-stream outlet;

wherein the at least one chamber outlet surface of each chamber, except a last chamber in the series, is in airflow-stream connection with the chamber inlet surface of the following chamber, each said chamber being operative to receive the single contiguous treating airflow-stream through its chamber airflow-stream inlet and allow the single contiguous treating airflow-stream to pass through said chamber and exit through its chamber airflow-stream outlet;

wherein at least one chamber wall of at least one chamber in the series of two or more chambers has a partial-air-bypass incorporated into the at least one chamber wall through which air can traverse, the at least one chamber wall consisting essentially of:

an interior surface permeable to air;

an exterior surface substantially impermeable to air; and an open cell foam between the interior surface and the exterior surface; and wherein a portion of the single contiguous treating airflow-stream passes through the permeable interior surface, through at least a portion of the open cell foam, travels substantially parallel to the single contiguous treating airflow-stream, and back through the permeable interior surface, allowing the portion of the single contiguous treating airflow-steam to bypass an airflow-stream blockage within said chamber and remain in airflow-stream connection with the chamber airflow-stream outlet.

18. The system of claim 17 wherein the bag container further comprises a nominal internal length dimension, a nominal internal width dimension, and a nominal internal height dimension, and wherein the series of two or more chambers connected in airflow-stream series define a virtual airflow-stream tube having a length in excess of at least the greatest of the nominal internal length dimension, the nominal internal width dimension, or the nominal internal height dimension of said bag container.

19. A method for treating two or more to-be-treated items with a single contiguous treating airflow-stream, comprising:

forming a bag to include positioning at least two chambers in a series, each chamber having an interior defined by surrounding surfaces comprising substantially nonporous material, including at least one chamber inlet surface having a chamber airflow-stream inlet, which is in airflow-stream connection with a bag inlet, and at least one chamber outlet surface having a chamber airflow-stream outlet, which is in airflow-stream connection with a bag outlet, the at least one chamber outlet surface of each chamber, except a last chamber in the series, connected to the at least one chamber inlet surface of the following chamber, wherein the at least two chambers are connected in airflow-stream series and define a virtual airflow-stream tube having a length in excess of at least the greatest of a nominal internal length dimension, a nominal internal width dimension, and a nominal internal height dimension of said bag, wherein at least one chamber wall of the at least two chambers comprises an air-bypass, the at least one chamber wall consisting essentially of:

an interior surface permeable to air;

an exterior surface substantially impermeable to air; and an open cell foam between the interior surface and the exterior surface;

wherein a portion of the single contiguous treating airflow-stream passes through the permeable interior surface, through at least a portion of the open cell foam, travels substantially parallel to the single contiguous treating airflow-stream, and back through the permeable interior surface, allowing the portion of the single contiguous treating airflow-stream to bypass an airflow-stream blockage within the chamber and remain in airflow-stream connection with the chamber airflow-stream outlet.

20. The method of claim 19 further comprising:

providing an airflow source configured for generating the single contiguous treating airflow-stream.

21. The method of claim 20 wherein the bag is adapted for:

utilizing ambient air in the single contiguous treating airflow-stream;

heating the single contiguous treating airflow-stream;

adding a sanitizing substance to the single contiguous treating airflow-stream; or adding an odorizing substance to the single contiguous treating airflow-stream.

22. The method of claim 19 wherein the single contiguous treating airflow-stream is introduced to the series by exhausting the single contiguous treating airflow-stream through a source outlet of a source by at least one of:

providing a hollow conduit that connects the source outlet to the chamber airflow-stream inlet of the first chamber in the series;

positioning the series on top of the source and connecting the chamber airflow-stream inlet of the first chamber to the source outlet;

positioning the source on top of said series and connecting the chamber airflow-stream inlet of the first chamber to the source outlet; and positioning the source on a side of said series and connecting the airflow-stream inlet of the first chamber to the source outlet.

23. A system comprising:

a source for generating a single contiguous treating airflow-stream, the source having a source inlet for collecting air and a source outlet for directional discharge of the single contiguous treating airflow-stream;

a bag for storing, transporting, and protecting at least one to-be-treated item, said bag having a bag inlet for receiving the single contiguous treating airflow-stream and a bag outlet for exhausting the single contiguous treating airflow-stream;

a series of two or more chambers connected in airflow-stream series to said bag inlet and outlet; said two or more chambers forming at least a portion of said bag;

wherein said two or more chambers have an interior defined by surrounding surfaces comprising substantially nonporous material and connected in such a manner that the series of two or more chambers define a virtual airflow-stream tube having a length in excess of at least the greatest of a nominal internal length dimension, a nominal internal width dimension, and a nominal internal height dimension of said bag, wherein at least one chamber wall of the two or more chambers comprises an air-bypass, the at least one chamber wall consisting essentially of:

an interior surface permeable to air;

an exterior surface substantially impermeable to air; and an open cell foam between the interior surface and the exterior surface;

and wherein a portion of the single contiguous treating airflow-stream passes through the open cell foam, travels substantially parallel to the single contiguous treating airflow-stream, and back through the permeable interior surface, allowing the portion of the single contiguous treating airflow-stream to bypass an airflow-stream blockage within the chamber and remain in airflow-stream connection with the chamber airflow-stream outlet;

wherein the source is configured to introduce the single contiguous treating airflow-stream through the source outlet into the bag inlet, whereby the single contiguous treating airflow-stream passes through the series, treating at least one to-be-treated item, and passes out of the bag outlet; and wherein a means for re-circulation is located between the bag outlet and the source inlet for routing at least part of the single contiguous treating airflow-stream that exits the bag outlet, back to the source inlet.

24. A system for carrying and selectively treating one or more to-be-treated-items, comprising:

a source module for generating a flow of air; and a bag including:

a handle; and a carrying portion interconnected to the handle, the carrying portion including two or more compartments for holding the one or more to-be-treated-items;

wherein the bag is selectively attachable and detachable to the source module, the bag including an inlet opening interconnectable to the source module for receiving the flow of air from the source module, and wherein the two or more compartments are interconnected in airflow-stream series to the inlet opening such that the two or more compartments are configured to provide air flow directly from an interior of a first compartment of the two or more compartments to an interior of a second compartment of the two or more compartments; and wherein at least one of the two or more compartments has an integral partial-air-bypass structure, wherein the integral partial-air-bypass structure is a chamber wall consisting essentially of an interior surface substantially permeable to air, an exterior surface substantially impermeable to air, and an open cell foam between the interior surface and the exterior surface configured to provide air flow at least partially through the integral partial-air-bypass structure.

25. The system of claim 24 wherein the source module further comprises a sanitizing unit for introducing ozone into the flow of air.

* * * * *